United States Patent [19]

Heisler

[11] 4,089,150

[45] May 16, 1978

[54] APPARATUS AND METHOD FOR CASE PACKING SMALL CONTAINERS AND ARTICLES

[76] Inventor: Raymond A. Heisler, 657 Dakota Trail, Franklin Lakes, N.J. 07417

[21] Appl. No.: 799,729

[22] Filed: May 23, 1977

[51] Int. Cl.[2] ..... B65B 43/28; B65B 35/50; B65B 57/10

[52] U.S. Cl. ..... 53/29; 53/62; 53/164; 53/186; 53/252; 93/53 SD; 214/6 BA

[58] Field of Search ..... 53/29, 164, 186, 252; 93/53 SD; 214/6 BA

[56] References Cited

U.S. PATENT DOCUMENTS

| | | | |
|---|---|---|---|
| 3,740,919 | 6/1973 | Heisler | 53/186 X |
| 3,881,298 | 5/1975 | Griner et al. | 53/186 X |

*Primary Examiner*—Travis S. McGehee
*Attorney, Agent, or Firm*—Ralph R. Roberts

[57] ABSTRACT

This invention discloses an apparatus and method for receiving small containers and articles in a determined array and from a single side accumulating and feeding these containers or articles in a series of loading moves into the end of an erected carton. In the embodiments shown, provision is made for a carton size change within determined limits. These case packing apparatus assemblies shown are for packing small containers such as quart or pint paint containers and in an alternate arrangement for packing a multiplicity of sponges. Automatically actuated fingers that engage the lower extent or surface of folded cartons and then move into slots to engage upper flaps or carton extents are also shown.

36 Claims, 29 Drawing Figures

APPARATUS AND METHOD FOR CASE PACKING SMALL CONTAINERS AND ARTICLES

CROSS REFERENCE TO RELATED UNITED STATES PATENTS

The present invention, to the extent applicable, discloses case packing apparatus similar to that seen in my U.S. Pat. No. 3,740,919, issued on June 26th, 1973 based on application Ser. No. 204,872, filed Dec. 6th, 1971 and entitled, "Apparatus and Method for Orienting and Case Packing Bailed Containers"; U.S. Pat. No. 3,814,000, issued June 4th, 1974 based on the application Ser. No. 336,246 and entitled, "Apparatus for Automatically Feeding and Erecting Folded Cartons"; U.S. Pat. No. 3,848,394 which issued Nov. 19th, 1974 based on the application Ser. No. 373,752 and entitled, "Apparatus and Method for Orienting and Case Packing Eared Containers"; U.S. Pat. No. 3,858,490, issued on Jan. 7th, 1975 based on the application Ser. No. 450,400 and entitled, "Method for Automatically Feeding and Erecting Folded Cartons", and application Ser. No. 698,401, filed June 21st, 1976 and entitled, "Apparatus and Method for Automatically Feeding and Erecting Folded Cartons".

BACKGROUND OF THE INVENTION

1. Field of the Invention

With reference to the classification of art as established in the United States Patent and Trademark Office the present invention is believed to relate to art as found in the general Class entitled, "Package Making" (Class 53) and the subclass entitled, "group forming of contents unit" (subclass 26) and also in the subclass entitled, "receptacle formed and subsequently filled" (subclass 29).

2. Description of the Prior Art

Patents directed toward case packing eared containers and other items are well known. Several recent U.S. Patents pertaining to apparatus for article positioning and case loading have been issued. Among these patents are U.S. Pat. No. 3,209,512 to FERGUSON, Jr., etal. which issued on Oct. 5th, 1965; U.S. Pat. No. 3,284,985 to ROTH which issued on Nov. 15th, 1966 and also U.S. Pat. No. 3,462,912 to ANDERSON which issued on Aug. 26th, 1969. In these and other known systems it is the intent to receive bailed, eared containers and to orient these containers so that with their bails laid against the side of the containers these containers, as a grouping, may be fed into an open, erected carton and with the containers in a determined oriented condition the carton is closed and sealed.

In the present invention and as reduced to practice, it is contemplated that the apparatus will place small containers in an erected carton.

A carton is provided of small height and an extent of width and length about the same as that in a carton for four or six one-gallon containers. This case packer also requires an adjustability in that for a period one-quart containers may be packaged and then one-pint containers and then intermediate and other sizes.

The present invention receives containers on a conveyor leading from a filling and lid applying mechanism or other container advancing means. In a preferred embodiment these containers are brought to a feed conveyor whereat the containers are delivered by an accumulating conveyor to an orienting mechanism where they are arranged in groups of three or four. These containers as a group are then fed into an open side of an erected carton. After the carton has been filled with a selected number of containers, the carton is advanced to a closing, sealing and delivering mechanism.

In addition to the embodiment pertaining to a case packing of containers particularly for paint and the like, there is also disclosed the adapting of this apparatus to the packaging of stackable items such as sponges. As with the containers, this apparatus is made adjustable for a ready size change in sponges and their packages. An up-stacking device and transfer pusher for moving the accumulated packaged articles into the open side of an erected carton is provided.

SUMMARY OF THE INVENTION

This invention may be summarized at least in part with reference to its objects.

It is an object of this invention to provide, and it does provide, an orienting apparatus adapted to receive containers aligned in a determined array and to feed these containers to an apparatus wherein the containers are oriented in a desired array and arranged into columns and arranged for the simultaneous discharge into the open side of an erected carton. The filled carton with these containers therein is then transferred to closing, gluing and discharging operations.

It is a further object of this invention to provide, and it does provide, orienting apparatus adapted to receive containers delivered in a random array and to orient the containers so that they are grouped for simultaneous insertion into an open side of an erected carton after which the flaps of the carton are closed and glued as and after which the carton is advanced for delivery to a conveyor or pallet. The carton erecting equipment includes a flat carton receiving station which is adjustable and whereat a supply of cartons in stored in a substantially vertical condition and from which they are fed to a carton chute in which a supply of cartons is supported in a more-or-less horizontal condition and in which a finger arrangement assists in the opening of the carton. From the bottom of the chute the cartons are engaged by suction cups carried on an arm which is cycled so as to withdraw a carton from the chute and erect this same carton while delivering to a carton conveyor apparatus.

In the packaging of articles such as sponges in which there is a grouping of articles in a stacked arrangement an up-stacker is used with a signal device which counts the accumulation and also accommodates the articles in rows which are then moved into a grouping which is moved as a unit into the open, erected carton.

In a preferred embodiment the pusher engages, guides and transfers adjacent containers into one open end of the carton, the pusher engages the containers to insure a positive alignment.

In both the container and article packaging apparatus there is provided means for adjusting the carton feed and the packaging apparatus to conform a retention of the product in the erected carton. Transfer of the accumulation of articles or containers into the erected carton is by a pusher which is actuated by and with a timing and counting circuit. As many of the cartons have large panels in relation to their height and because of lack of accuracy in the manufacture of cartons and the weakness in these large panels there is provided finger means which selectively engages the upper panel during erecting.

In addition to the above summary the following disclosure is detailed to insure adequacy and aid in understanding of the invention. This disclosure, however, is not intended to prejudice that purpose of a patent which is to cover each new inventive concept therein no matter how it may later be disguised by variations in form or additions of further improvements. For this reason there has been chosen a specific embodiment of the orienting apparatus for positioning and case packing small containers and showing a preferred means for orienting and grouping the containers into groups and with a pusher placing them into the open side of a carton. This specific embodiment and an alternate embodiment employing the stacking, grouping and inserting into the open side of a carton of articles such as sponges have been chosen for the purposes of illustration and description as shown in the accompanying drawings wherein:

BRIEF DESCRIPTION OF THE DRAWINGS

FIG. 26 represents a diagrammatic, sectional view of the upstacker apparatus for sponge groupings and the like;

In the following description and in the claims various details are identified by specific names for convenience. These names are intended to be generic in their application. Corresponding reference characters refer to like members throughout the several figures of the drawings.

The drawings accompanying this specification disclose certain details of construction for the purpose of explanation but it should be understood that details may be modified in various respects without departure from the concept of the invention and that the apparatus for case packing may be incorporated in other forms than shown.

EMBODIMENT OF FIGS. 1 AND 2

Figure 1:
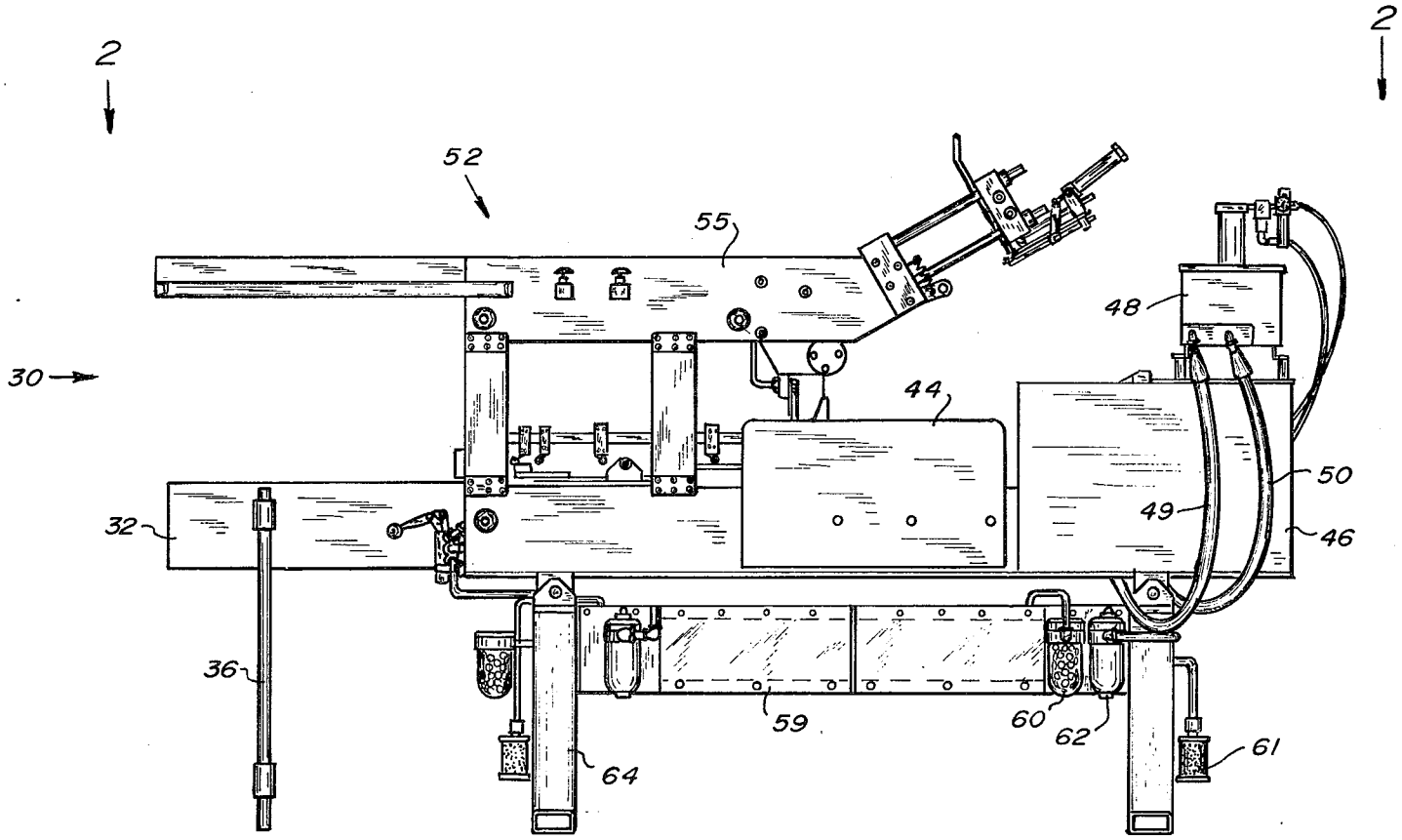
FIG. 1 represents a side view of an apparatus for case packing small containers in cardboard cartons automatically erected, filled, closed, glued and delivered, this view taken on the line 1—1 of FIG. 2 and looking in the direction of the arrows.
Figure 2:
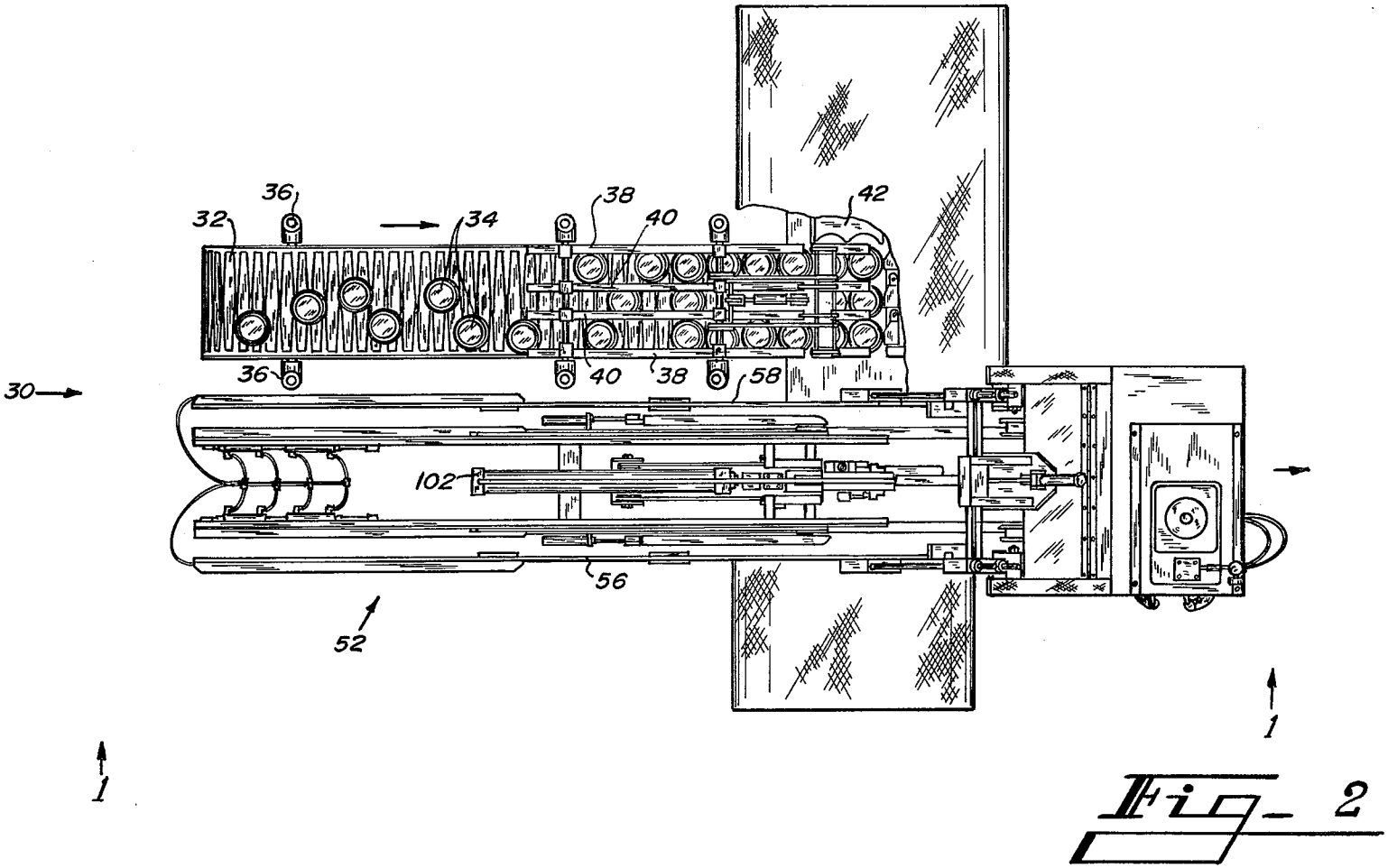
FIG. 2 represents a plan view of the apparatus of FIG. 1, this view taken on the line 2—2 of FIG. 1 and looking in the direction of the arrows.

Referring next to the drawings and in particular to FIGS. 1 and 2, there is shown the adjustable case packer arranged for an accumulation and packing in an erected cardboard carton. As shown, the apparatus is generally indicated as 30 and includes an infeed conveyor 32 on which a supply of small containers 34 is advanced and grouped and when a desired amount is accumulated these containers are placed in an erected carton, not shown. A plurality of legs 36 support the conveyor and place and position the transport surface at the desired height and slope.

In the feeding of the containers 34 and arranging them in aligned rows there is provided side and intermediate guides 38 and 40 which, as depicted, align containers in three rows longitudinally of the conveyor. By a sensing means, not shown, a determined grouping of containers in a precise arrangement is accumulated.

In the embodiment of FIG. 2, a pusher 42 is moved to transfer (as arranged and reduced to practice) six containers 34 into an erected carton, not shown. This carton, after filling, is transferred from the filling station 44 (FIG. 1) to a gluing and closing station 46. Heated glue from a pot 48 actuated by a timed signal is fed through lines 49 and 50 to conventional nozzles.

Above and to the side of the conveyor 32 is carried the carton storage and delivery apparatus 52. This includes a walking beam moved by a cylinder. The actuation and operation of this walking beam and carton advance is shown in detail in my application, Ser. No. 698,401, filed on June 21, 1976. In this application is particularly shown the adjustable means which is later described with reference to the drawing of that application. The side walls 56 and 58 (FIG. 2) are movable to the desired width by apparatus to be hereinafter described. The chute into which these cartons are delivered is also shown and described in detail in application Ser. No. 698,401 and to the extent applicable is incorporated in the present application. Reference is made to the drawings and description of FIGS. 2A, 2B, 3, 4, 5 and 7 through 11 of application Ser. No. 698,401. The side width adjustable mechanism and the adjustment and automatic compensation for size changes are more fully discussed in conjunction with the drawings of the present application to be later discussed. On and below chest 59, as seen in FIG. 1, are shown filters 60, mufflers 61 and lubricators 62 which are similar in purpose and use as in the patents above-noted. Legs 64 carry this chest 59.

EMBODIMENT OF FIG. 3

Figure 3:
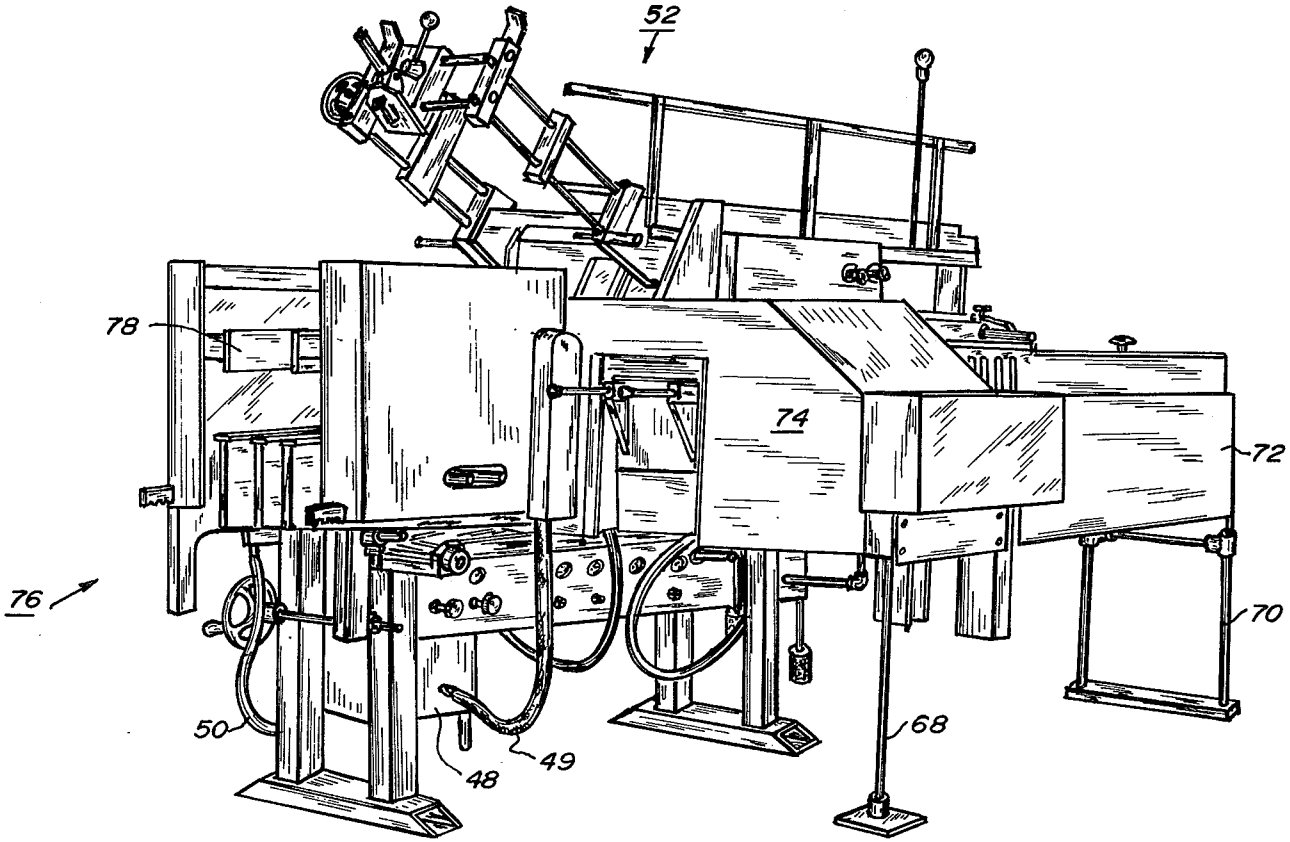
FIG. 3 represents an isometric view, partly diagrammatic, of a case packing apparatus like that of FIG. 1 as arranged for packing stacked articles such as sponges.

In FIG. 3 is shown the adjustable apparatus of FIG. 1 as arranged for accumulating sponges. On the near side and carried by legs 68 and 70 is a sponge feeding and up-stacking conveying apparatus generally indicated as 72. A transfer section 74 encloses the actual transfer apparatus. The carton erecting mechanism 52 is very similar to that shown in FIGS. 1 and 2 and to be hereinafter more fully described in conjunction with more detailed drawings. The frame for the carton erecting and transport is adjustable in width and, as depicted, includes adjustably spaced lower slide members 76 and flap pressing plates 78. From a heated glue supply 48 lines 49 and 50 carry hot glue which is applied to flap portions of the carton before closing and delivering to a palletizer, now shown.

Figure 4:
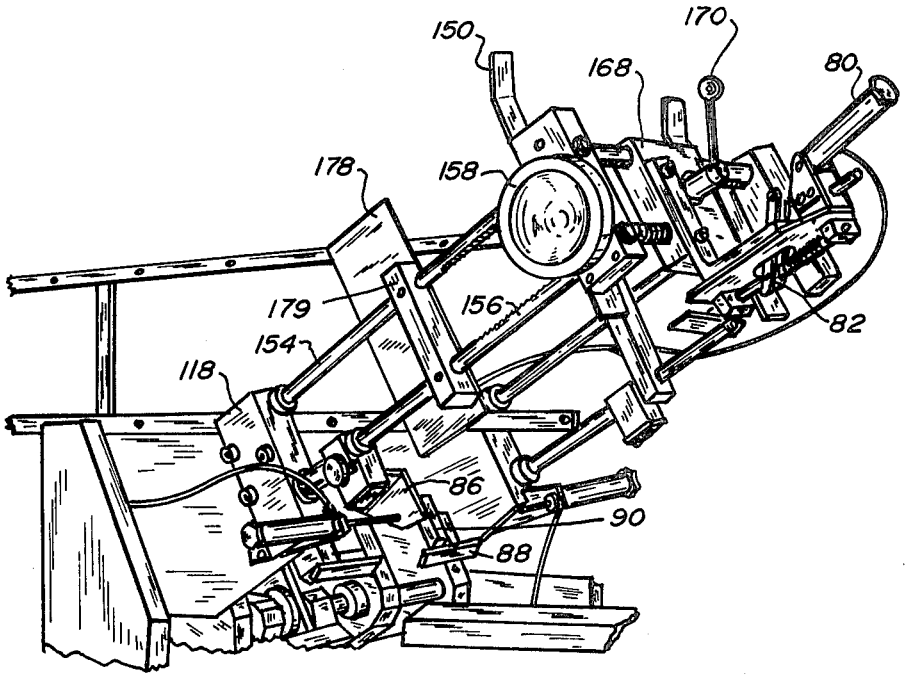
FIG. 4 represents a partly fragmentary, isometric view and partly diagrammatic of the adjustable carton carrier from which flat cartons are withdrawn one at a time.
Figure 5:
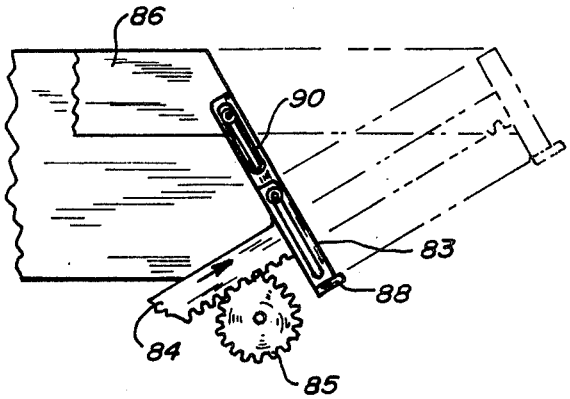
FIG. 5 represents a fragmentary, side view, partly diagrammatic of the adjustable chute of FIG. 4 and the means for an automatic and rapid adjustment.
Figure 6:
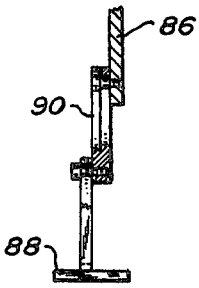
FIG. 6 represents a fragmentary, partly diagrammatic, sectional view of the carton support plates and their interleaving adjustment as the chute is adjusted to suit the sized of the folded carton.

CARTON ESCAPEMENT AND ADJUSTMENT AS SHOWN IN FIGS. 4, 5 and 6

Referring now to the drawing in which is shown FIGS. 4, 5 and 6, there is depicted in the fragmentary view of FIG. 4 the adjustable chute for receiving folded cartons and from this chute the cartons are withdrawn. Reference is made to my application Ser. No. 698,401, filed June 21, 1976. An air cylinder 80 actuates a pivoted arm 82 which holds the stack of cartons while releasing the bottommost carton as described in this application.

ADJUSTMENT IN ACCORDANCE WITH FIGS. 5 and 6

In FIGS. 5 and 6 is depicted a means for adjustment of the lower stop for the carton. It is usually desired that the carton be centered as to the suction cups that are brought to the lower panel. This lower stop is movable from a maximum opening, as seen in solid outline in FIG. 5, to an outer or upper limit shown in phantom outline. It is to be noted that the face 83 of this stop is at a determined angle such as twenty to thirty degrees from the vertical. A rack and pinion 84 and 85 are disposed to rapidly and positively move this stop 83 to the limits shown. An upper slide member 86 is at the established horizontal level during all positions of the lower stop. A lower lip or shelf 88 is attached to the rack 84 and at its upper edge carries slotted filler strips 90 which are also attached at their upper edges to slide member 86. As the slide member 86 moves rightward, the stop 83 is also moved to the right and upward by rack 84. The slotted members 90 accommodate the space between to provide a smooth support stop surface for the stack of folded cartons.

CARTON DELIVERY OF FIG. 7

Figure 7:
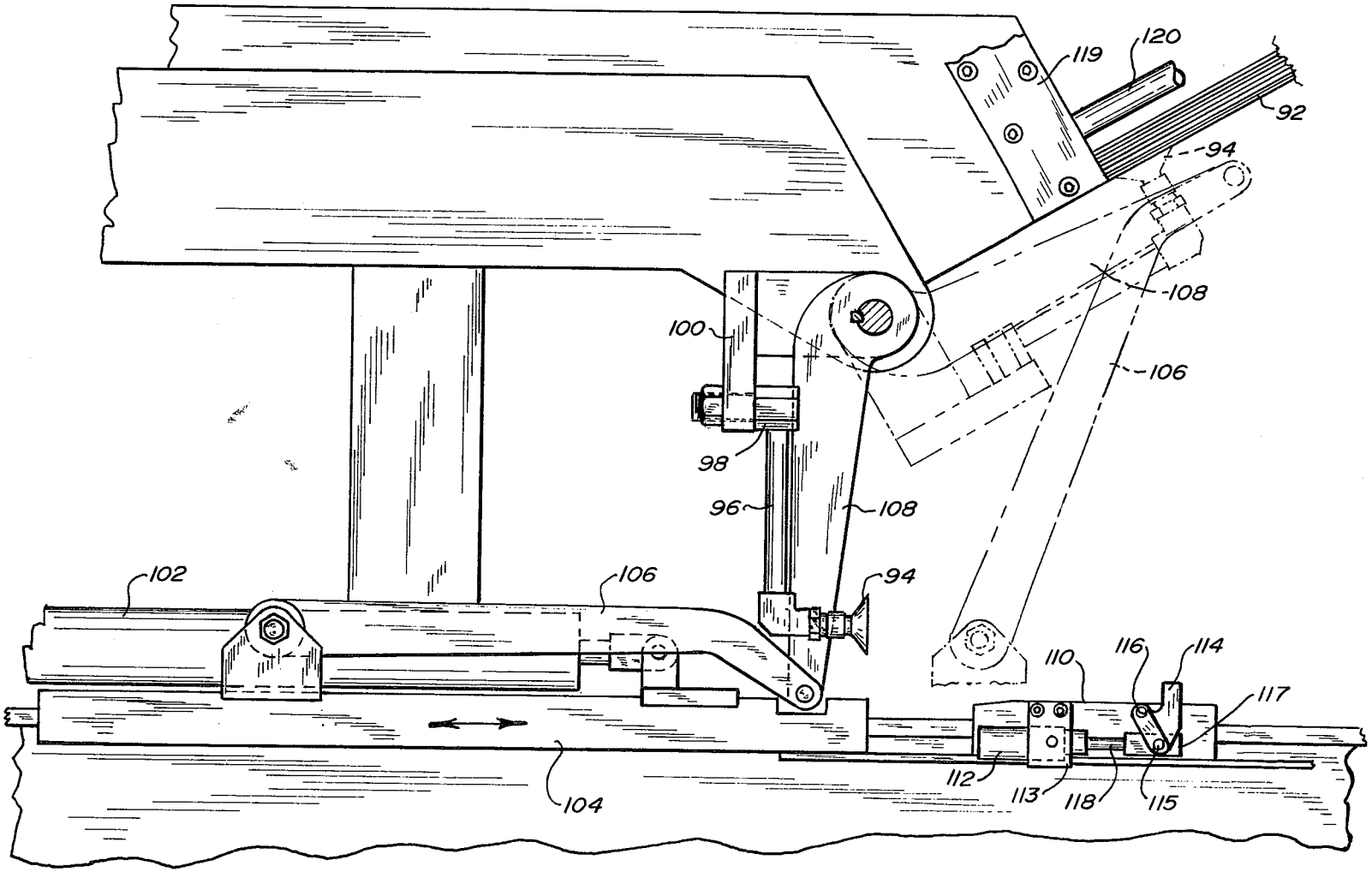
FIG. 7 represents a fragmentary side view in an enlarged scale of the vacuum cup arm and actuating apparatus by which the flat carton is withdrawn from the stack and then erected.

Referring now to the drawing and to FIG. 7 in particular, there is shown a stack of folded cartons 92 which are disposed in an attitude for ready grasping and engagement by one or more pneumatic suction cups 94. As depicted, a plurality of suction cups 94 is each carried by a hollow arm 96 connected to a manifold 98 which is carried by a support 100. In the erecting and transferring of the cartons two stages or steps are contemplated. In the present embodiment an air cylinder 102 moves a platform member 104 and the forward propulsion of this platform member moves a pivotally mounted link 106 and a connected arm 108 in a counterclockwise rotation. Arm 108, as it rotates, moves the suction cups 94 and arms 96 to the position shown in phantom outline. When and as the cups are brought into engagement with the lower surface of the folded carton 92 suction is applied and this carton is withdrawn in the manner of the above-described reference application. Suction as it is applied to these cups 94 enables these cups to grasp the lower panel of the carton 92.

Moved in combination and with this platform member 104 is a forward slide 110 which carries an air cylinder 112 as retained by a clamp 113. When actuated the cylinder rotates a stop finger 114 which is pivotally moved with the movement of pin 115 and is pivotally retained by a transverse shaft 115. Shaft 115 is retained by and moved with clevis end 117 carried on the outer end of piston rod 118. As shown in solid outline, finger 114 acts as and provides a forward engaging shoulder for the carton as it is erected, filled and then transported forwardly.

Finger 114 in practice is a plurality of like members which is moved to the stop position shown in solid outline by cylinder 112 when in the carton erecting position. The fingers 114 engage the forward edge of the carton and retain this erected condition as the platform member 104 carries the erected and filled carton forwardly. After the filled carton has been transported forwardly, the cylinder 112 is again actuated to move the piston rod 118 toward the piston and to cause the fingers 114 to rotate around shaft 116 and move to a disengaged or non-engaging condition.

Also as seen in FIG. 7 is a support block 119 which carries the lower portion 120 of the chute that carries the folded cartons 92 when they are brought into a forward repose position.

PNEUMATIC FLAP ENGAGING FINGER OF FIGS. 8 AND 9

Figure 8:
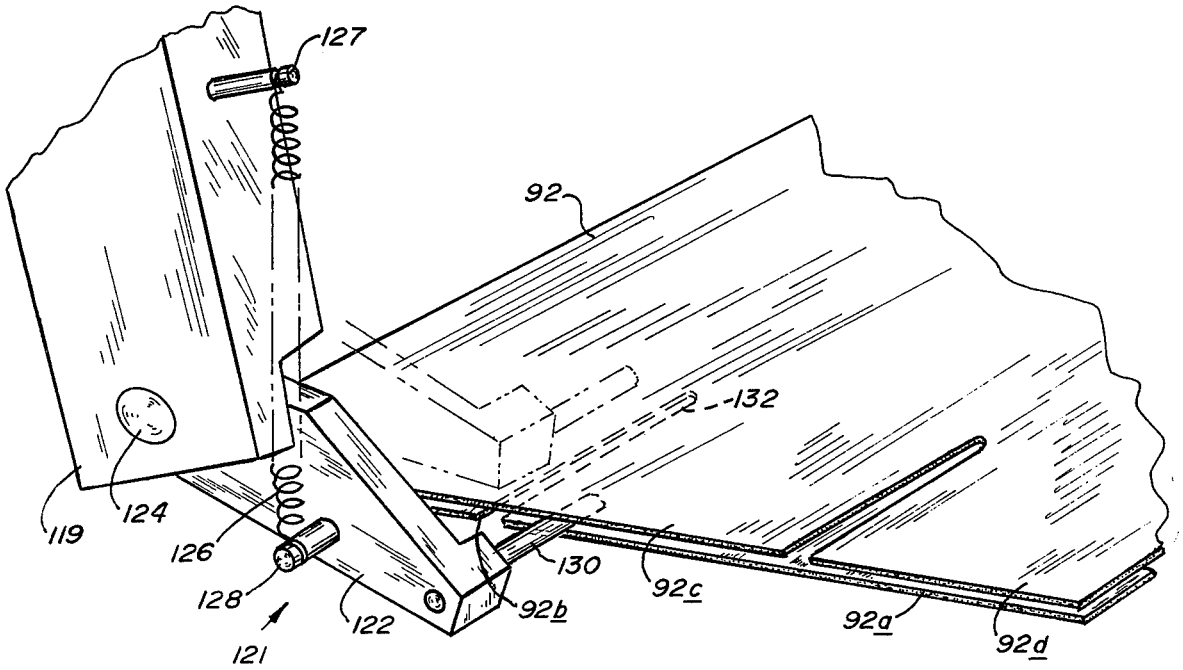
FIG. 8 represents an isometric view, partly fragmentary, of an automatic upper flap engaging finger as and after it has passed through a lower slot and has engaged the upper flap.
Figure 9:
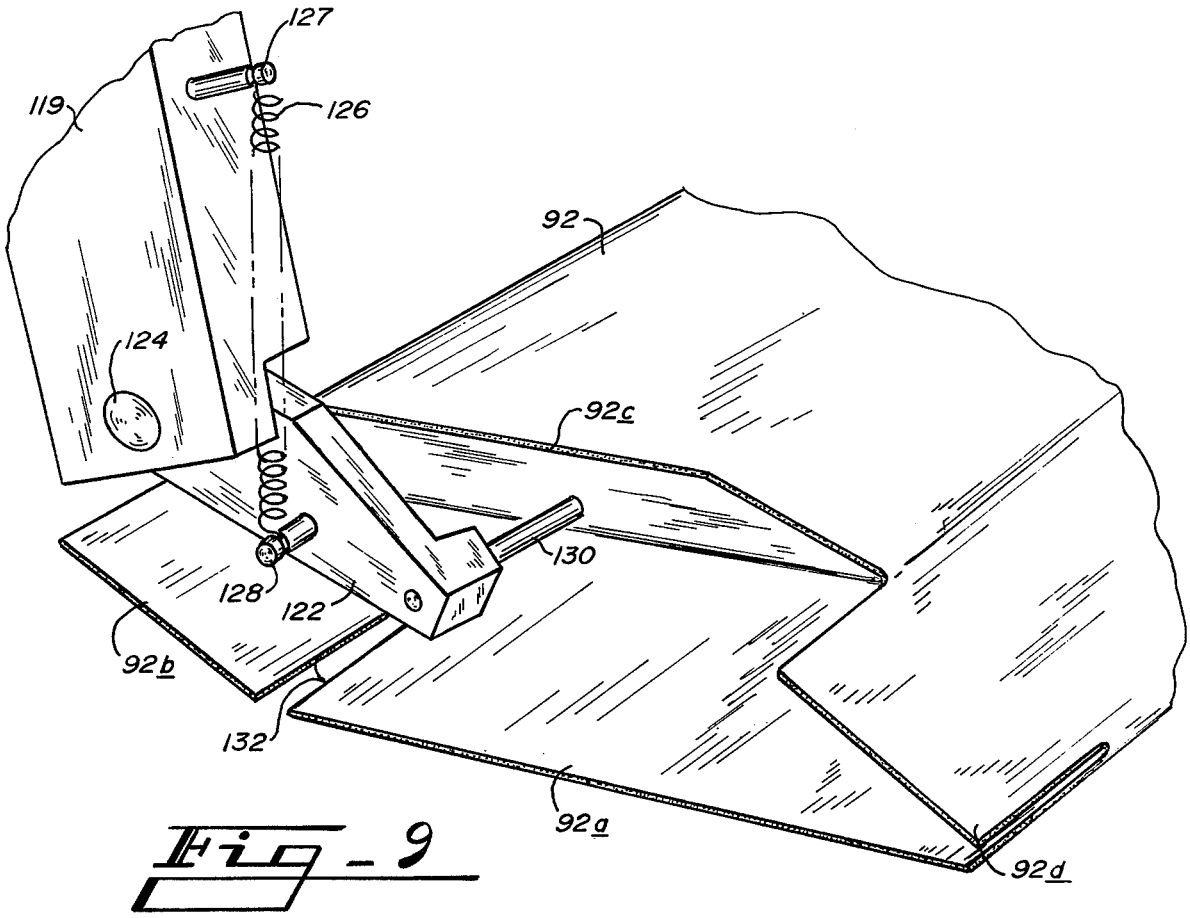
FIG. 9 represents the partly fragmentary, isometric view of FIG. 8 with the pivoted finger in engagement with the upper flaps of the carton as this carton is withdrawn from the hopper.

Referring next to FIGS 8 and 9, there is shown in an enlarged scale an automatic flap engaging finger assembly 121 which is pivotally mounted to member 119 of the carton delivery chute. This finger includes an arm 122 pivotedly carried by a pin 124. A spring 126 is tensioned and secured to extend between the outer ends of pins 127 and 128. Pin 127 is secured to member 119 and pin 128 is mounted in pivot member 122. On the distal end of swinging arm 122 is flap or carton engaging finger pin 130. In the use and operation of this finger pin 130 it is noted that when the carton flap is positioned, as in FIG. 8, the carton is grasped by the suction cups 94, as seen in FIG. 7. As the end panel **92*b* is grasped and begun to be pulled down, the pivoted finger pin 130 finds and enters slot 132 and moves upward through this slot to engage the upper flap 92*c* of the folded container 92. As the carton is moved further downwardly to be withdrawn from the stack, the carton panel 92*b* proceeds downwardly as drawn by the suction cups 94 and the finger pin 130 moves into engagement with the flap 92*c* to urge this flap into an open condition. Flaps 92*b* and 92*d* are continuations of the panels of the carton members until the carton is begun to be erected. This carton when erected is carried by the transport mechanism and in an open condition is positioned for insertion of the items to be packaged. At the time of the opening of the folded carton 92, and after the carton has been withdrawn from the chute, the finger assembly 121 is drawn upwardly by spring 126 and moves into an engaging position below the lower flap 92*a*** of the next or succeeding carton.

This finger pin 130 engages this lower outer surface of this next folded carton as and until the carton is grasped and engaged by the suction cup 94 which draws the carton downwardly. This finger pin 130 and the one oppositely disposed acts as and provides the lower carton support until the suction cups 94 engage the panel portion **92*b*** to engage the flat carton and with vacuum applied draws the carton from the delivery chute.

AUTOMATIC FINGER FLAP ENGAGING PIN OF FIGS. 10 AND 11

Figure 10:
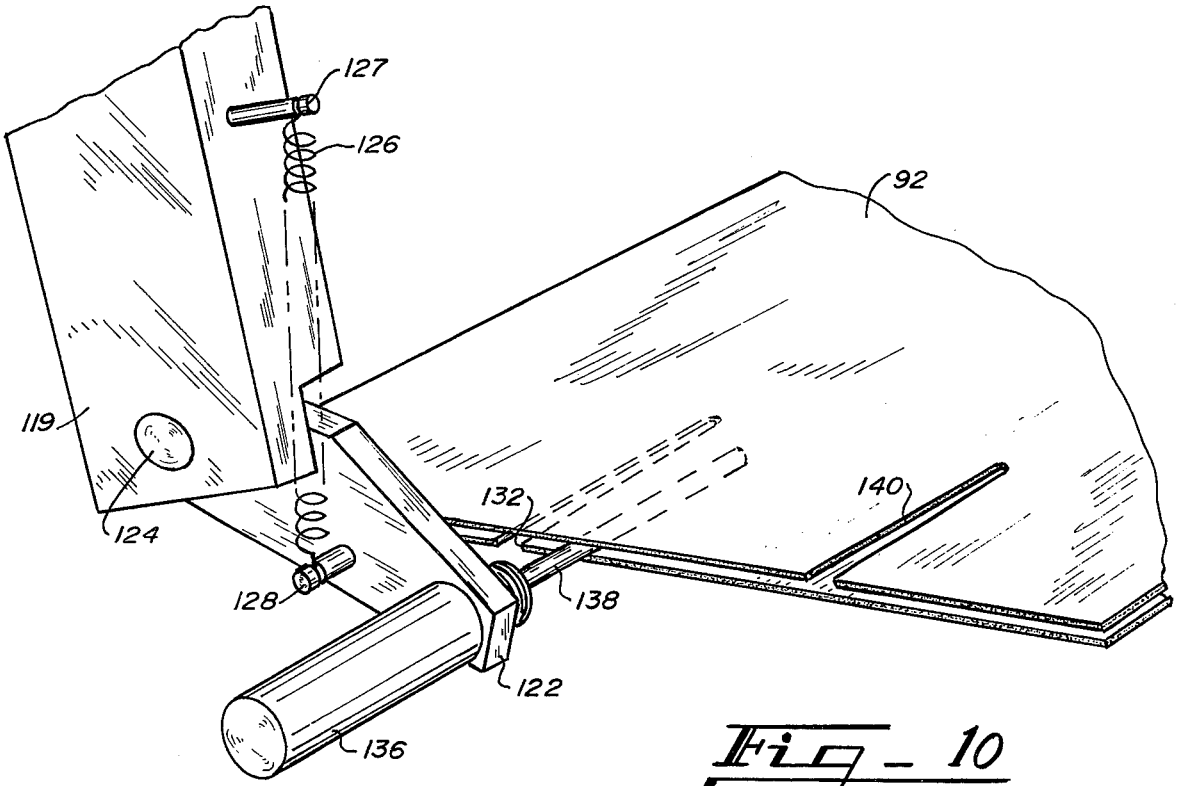
FIG. 10 represents an isometric view, partly fragmentary, of a carton flap engaging finger as in FIG. 8 but with the carton engaging pin actuated by a pneumatic cylinder.
Figure 11:
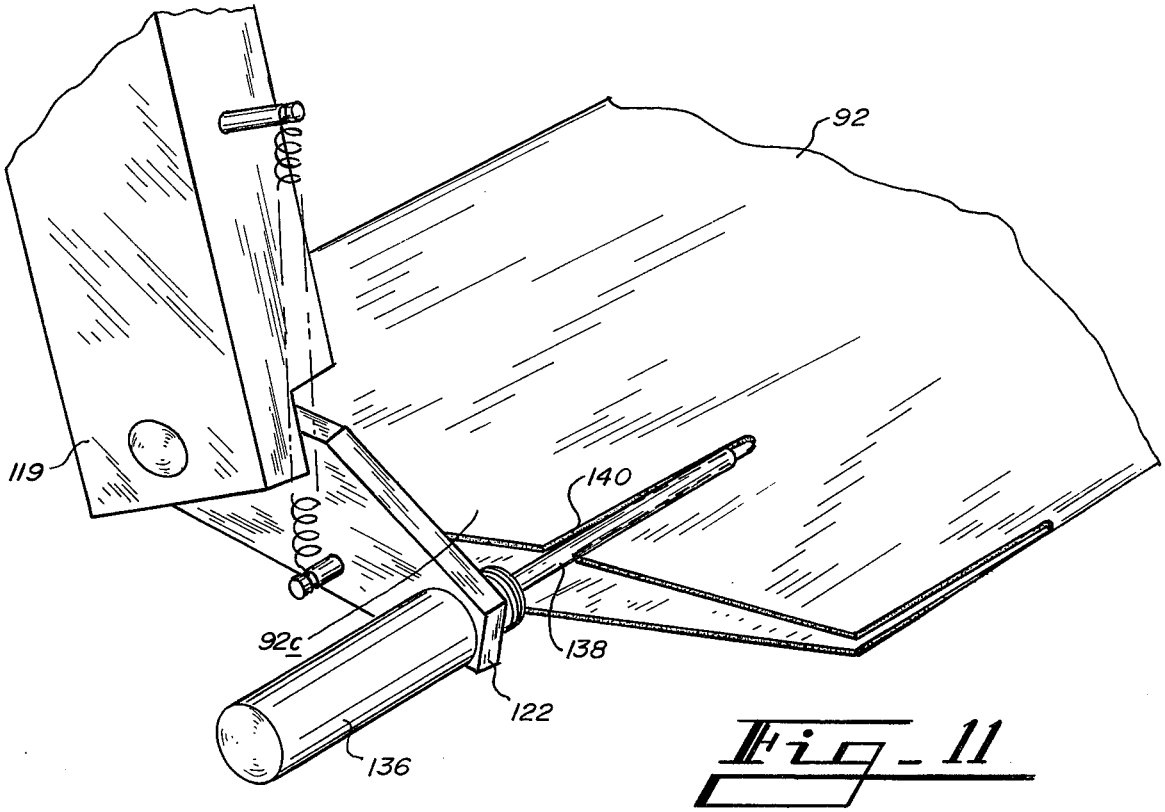
FIG. 11 represents the partly fragmentary view of the flap engaging finger of FIG. 10 with the finger in engagement with the upper flap as this carton is withdrawn from the hopper.

Referring next to FIGS. 10 and 11, it is to be noted that the score lines on some carton are easily bent and it is not desirable that the upper flap be bent during the opening of the carton. When this occurs there is provided a pneumatically actuated finger pin which is movable outward at a signal to release the carton. As depicted, arm 122 is pivotally retained by pin 124 mounted in member 119. Pins 127 and 128 and mounted spring 126 urge the arm 122 upwardly. In the embodiment shown, a small pneumatic cylinder 136 is mounted in a hole formed in arm 122 and adapted to push a plunger pin 138 at an appropriate signal into a forward position. This position may be adjusted for any depth of pin pnentration that is desired. As in the chute shown in FIGS. 8 and 9, the chute and the carton 92 in FIGS. 10 and 11 show the carton beginning a downward movement with the pin 138 moved into and through slot 132. The retracted pin is lesss than the depth or length of this slot 132. As the carton is moved further downwardly, as seen in FIG. 11, the pin first engages and then slides transversely of the upper flap **92*c* and proceeds rightwardly to the slot 140** from whence it escapes to again move to an engaging position on the lower surface of the next above carton.

Where and when the upper extent of the carton is so great that pin 138 does not reach the slot 140, pins 138 may be withdrawn by cylinder 136 when and as a certain determined pull upon the carton has been expended. This permits the withdrawal of the pin 128 from engagement with the carton whenever the carton has been substantially opened and the scores broken and when the travel of the pin 138 does not proceed as far as the slot 140. In use it is to be noted that the plunger pin is of a length which in engagement with the upper flap or surface extends no deeper than the slots 132 and 140. When a carton is drawn sufficiently from the chute, the plunger pin 138 is withdrawn to the extent that it can be moved through the slot 140 or withdrawn when this pin does not reach the slot 140. This pin is withdrawn to the extent that it allows the flap **92*c*** to pass the pin so that the carton may be moved into an erected position.

After the pin 138 has been withdrawn to the desired extent and the carton 92 has been erected, spring 126 urges the arm 122 upward to the upper limit as established by the upper surface of the arm 122 as it moves in the cutout portion formed in the member 119. A mirror image of the arrangement of the FIGS. 8 and 9 and FIGS. 10 and 11 are provided at the other side of the chute in which is carried the folded cartons so that when the cartons are in their forwardmost condition an engagement of the lowermost panel of the carton, as seen in FIG. 7, insures that only one carton is removed and erected. The slide plunger pins accommodate the sides and flaps of the container no matter the width and the extent or length of the flap. The lower stop 88, as seen in FIGS. 5 and 6, insures that the lower inner edge of the carton is retained as it is engaged by the suction cups for the purpose of erecting. The reciprocating finger as partially seen in FIG. 4 and described in detail in the above-identified application, Ser. No. 698,401, engages the outer edges of the carton and insures that only one carton at a time is released.

FORWARD GUIDE STOP AS SEEN IN FIGS. 12, 13 AND 14

Figure 14:
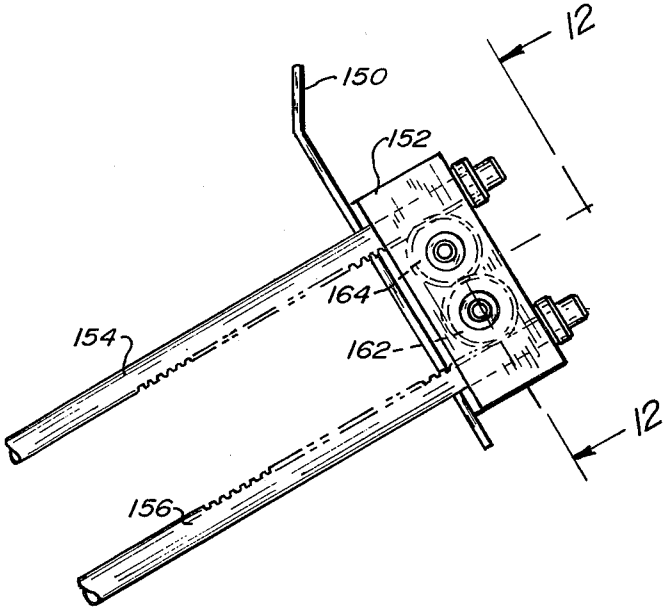
FIG. 14 represents a side view, partly fragmentary and diagrammatic of the front stop of and for the carton chute.
Figure 12:
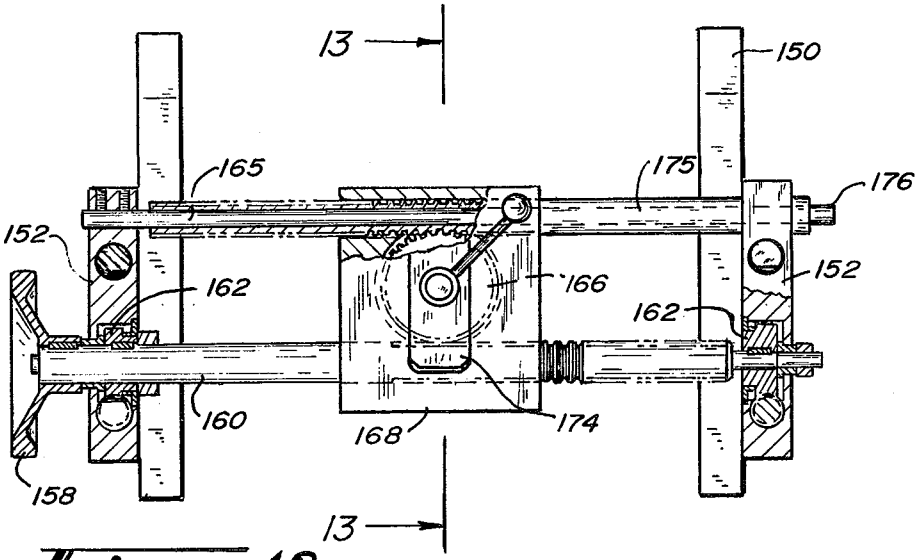
FIG. 12 represents a partly fragmentary and diagrammatic, front view of the side adjusting mechanism for the carton hopper.
Figure 13:
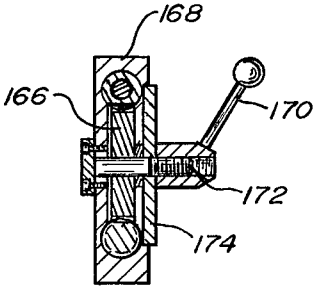
FIG. 13 represents a sectional view taken on the line 13—13 of FIG. 12 and looking in the direction of the arrows.

As depicted in FIGS. 12, 13 and 14, an upper guide stop includes an upper carton stop 150 carried by and inwardly of block members 152. Slidably carried in each of these blocks are rack members 154 and 156 with teeth formed in a portion of round rods. Like rack members are carried in each block. A hand wheel 158 is fixed to and carried on the shaft 160 which extends through the two block members 152 and within each of these block members there is formed bored recesses for like spur gears 162 which are in mesh with the lowr cylindrical rack 156. These gears are in mesh with like spur gears 164 carried also in recesses formed in block 152. The rotation of the hand wheel 158 causes a like rotation of the spur gear 162 which is transmitted to the in-mesh spur gear 164 and thence to the cylindrical rack members 154. Rotation of the hand wheel 158, therefore, causes the two spaced apart blocks 152 to move up and down the members 154 and 156 a like distance and/or speed. In this manner, the upper carton stops 150 are moved to the position desired.

In and out movement of the stops 150 and blocks 152 toward and away from a central position occurs when side plates 56 and 58 (FIG. 2) are moved to accommodate a particular size of carton. A spur gear 166 carried within a bore formed in block 168 provides a self-centering action when knob screw 170 is loosened on screw 172 to release a clamp bar 174.

USE AND OPERATION

As depicted, the rotation of hand wheel 158 causes the stops 150 to be moved up and down on members 154 and 156 so that both stops 150 are moved a like distance. The lower shaft 160 has its rack made as a series of cylindrical grooves and upper member 175 as a toothed sleeve portion carried on shaft 165. With knob 170 loosened, sides 56 and 58 are moved in and out of gear 166 rotates to cause a self-centering of block 168 as carried by the lower shaft 160 and its cylindrical rack tooth portion. A sleeve 175 having teeth on a portion thereof is rotatable on shaft 176 extending between blocks 152. As the blocks 152 and shafts 154 and 156 are moved in and out to accommodate the carton size associated side plates 178 and lower blocks 179 are likewise moved. Plates 178 and blocks 179 are seen in FIG. 4. Clamp bar 174 is tightened to lock shaft 160 at the desired position of the stops 150 on the shafts 154 and 156.

It is to be noted that at least in certain apparatus, the adjustable movement of blocks 152 may be achieved with only a pair of lower rack members 156, spur gears 162 and shaft 160 turned by hand wheel 150. Member 154 is merely a smooth rod and gear 164 in both blocks 152 is not provided. Shaft 160 and 175 has the circular rack portions as shown in FIG. 12. Up and down movement of blocks 152 may also be achieved utilizing a smooth rod instead of member 154. Spur gears 164 are not used but clamp bar 174 is provided and is loosened so hand wheel 158 may be turned to rotate shaft 160 and gears 162.

MAIN FRAME ADJUSTMENT AS SEEN IN FIGS. 15, 16 AND 17

Figure 17:
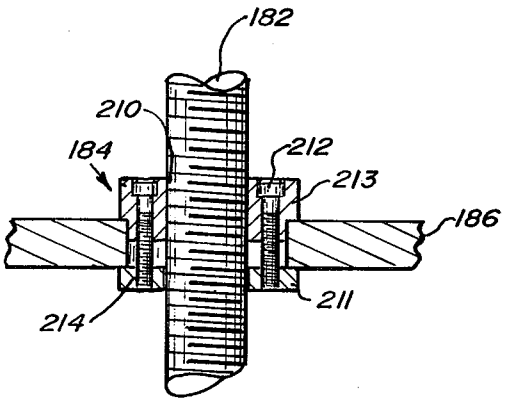
FIG. 17 represents in an enlarged scale a fragmentary sectional view of a typical threaded shaft and fixed nut as mounted in one of the movable frame plates.
Figure 15:
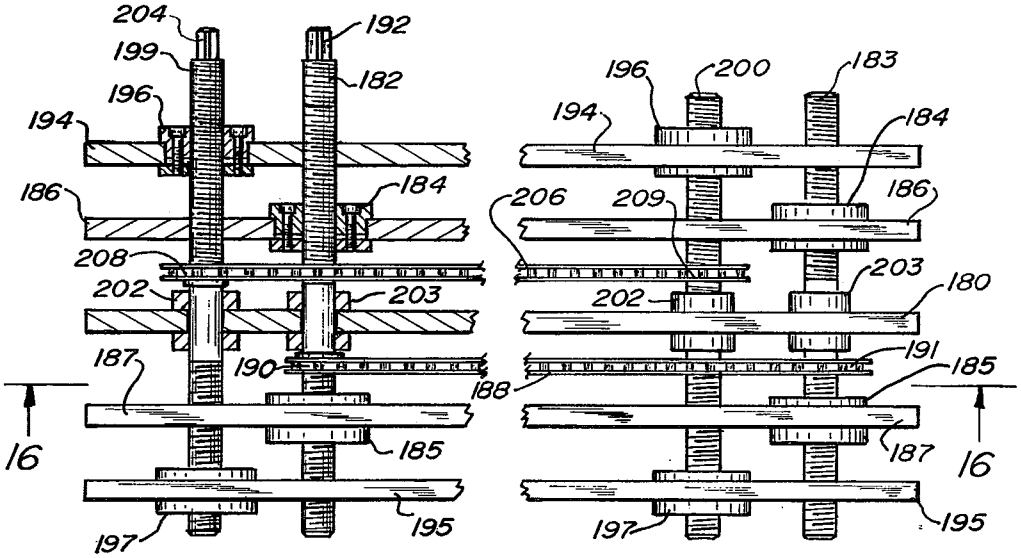
FIG. 15 represents a plan view, partly fragmentary and diagrammatic of the size adjustment mechanism of the adjustable frame of this packaging apparatus.
Figure 16:
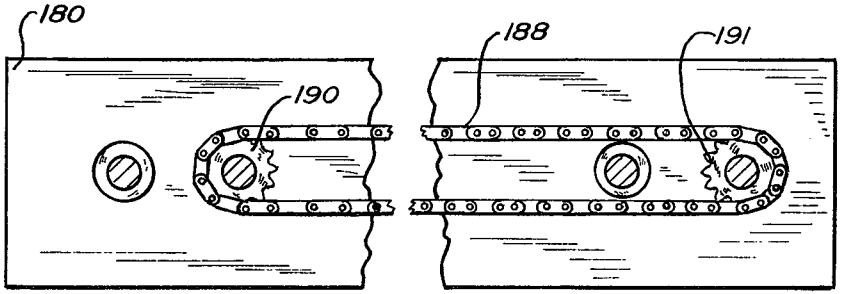
FIG. 16 represents a side view partly in section of an adjusting mechanism means, this view taken on the line 16—16 of FIG. 15 and looking in the direction of the arrows.

Referring next to the drawings and the showing in FIGS. 15, 16 and 17, there is depicted apparatus whereby the main frame which may consist of five members is adjustably positioned by means of turning only two transverse threaded shafts. As shown, a center member 180 carries shafts 182 and 183 which are formed with right- and left-hand threads and which engage and are carried in appropriately threaded right- and left-hand nuts 184 and 185. These nuts are fixed in intermediate plates 186 and 187. A roller chain 188 extends between and around and rotates sprockets 190 and 191 mounted respectively on shafts 182 and 183. Shaft 182, as depicted, has a squared end 192 by which an appropriate wrench means may be secured so as to turn the shaft either clockwise or counterclockwise. As the chain 188 is moved, associated sprockets 190 and 191 cause shaft 183 to be rotated a like amount. Appropriate rotation will cause the intermediate members 186 and 187 to be moved either toward or away from the center plate 180.

Outer plates 194 and 195 carry threaded nut members 196 and 197 which are threaded to accommodate right- and left-hand threads. These nuts retain shafts 199 and 200 which are formed with appropriate right- and left-hand threads. Shafts 199 and 200 are journaled for rotation with no longitudinal movement during rotating of the shaft. Attached collars 202 carried in holes in the center member 180 provide the journal means. Collars 203 are similar, if not identical, to collars 202 and are mounted on shaft 182 and 183 and rotatably retain these shafts in the center member 180. As formed on shaft 182, the upper portion of shaft 199 has a hex or square end 204 so that shaft 199 may be grasped and turned by a wrench to cause the outer plates 194 and 195 to be moved toward or away from each other.

Shaft 200 is rotated by a roller chain 206 which engages like sprockets 208 and 209 fastened respectively to shafts 199 and 200. As shaft 199 is rotated, sprocket 208 drives chain 206 and in a like manner sprocket 209 carried on shaft 200 so that as the rotation of shaft 199 is made by a wrench, the outer plates 194 and 195 are moved toward and away from each other.

As seen in FIG. 17 in the enlarged view, intermediate plate 186 carries shaft 182 in nut 184 which includes a threaded portion 210 which is shouldered to seat with a hole formed in plate 186. A tightening plate 211 draws nut 184 into a seated and tightened condition by cap screws 212 which pass through countersunk holes 213 and threaded holes 214 formed in plate 211. When screws 212 are tightened the nut portion 210 is clamped in position. This arrangement permits rotating of the shaft and spacing of the plate 186 from the center member 180. The companion plate 187 and nut 185 are disposed at a like distance to the other side of the center plate 180. It is to be noted that with the cap screws 212 loosened, the nut 184 may be rotated to a desired position before clamping. In a like manner the outer plate members 194 and 195 and nuts 196 and 197 are positioned and clamped after spacing from the center member and parallelism with the center member 180 has been established.

CONVEYOR ASSEMBLY OF FIG. 18

Figure 18:
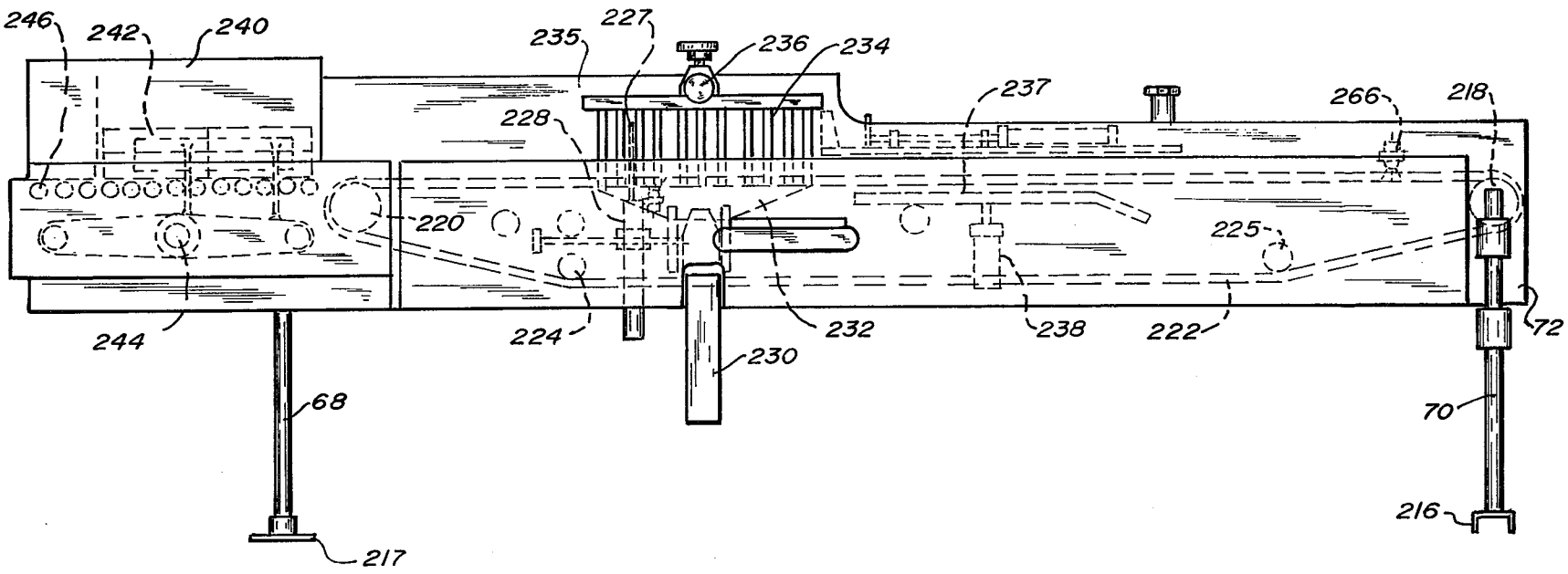
FIG. 18 represents a side view, partly diagrammatic of the up-stacking apparatus as arranged for packing sponges into cartons.

Referring next to FIGS. 18, there is depicted a side view of the conveying arrangement for the delivery of sponges and other such wrapped articles. This conveyor is carried on legs 68 and 70. Legs 70 are carried by cross tie 216. Frame 72 on its other end is carried by a leg 68 with a flange 217 used to provide a levelling means for the conveyor apparatus. Carried by forward and rear pulleys 218 and 220 are endless round belts which may be one-half inch in diameter and are seen in dashed outline and are identified as 222. The upper carrying extents of these belts are in a line parallel to the floor and top of the apparatus. The bottom portion of the return extent is deflected for a tightening by means of tightening pulleys 224 and 225. The articles to be packaged are delivered from a wrapping machine or similar apparatus by means of a conveyor, not shown. These articles are delivered onto the upper extents of these conveyor belts. These packages, not shown, are carried forward until they hit a stop finger 227 moved and carried by a cylinder 228. This stop finger accumulates a determined grouping of sponges or like members and in response to an electric eye, shown in another view, scans the receipt of a determined grouping. When this grouping has been achieved, cylinder 230 moves a stacker support 232 upwardly. This grouping of packages is then brought into a vertical gripping and stacking array, shown in detail in FIGS. 26, 27 and 28. Fingers are movable in louvered slots 234 in side plate 235.

These plates are moved to and from a gripping position by means of cylinder 236. After a determined grouping or stacking of wrapped packages has been accumulated, these fingers are released and this grouping is transferred by a pusher and belts, to be hereinafter more fully described. During the actuation of the up-stacker cylinder 230 and the platform 232, a clamp 237 actuated by a cylinder 238 grips any incoming package on the conveyor just prior to the upstacker so that the up-stacking is not effected by the on-coming or in-feeding packages which are thus inhibited from engaging or upsetting the balance of the stacked articles as they are transferred into position. At the transfer station, identified as 240, is pusher portion 242 which is moved by cylinder 244 in a manner to be hereinafter more fully described. A series of rollers 246 enable a transfer and insertion of the stacked articles into the open container in a manner to be hereinafter more fully described.

DETAIL OF THE CONVEYOR AS SEEN IN FIGS. 19 AND 20

Figure 20:
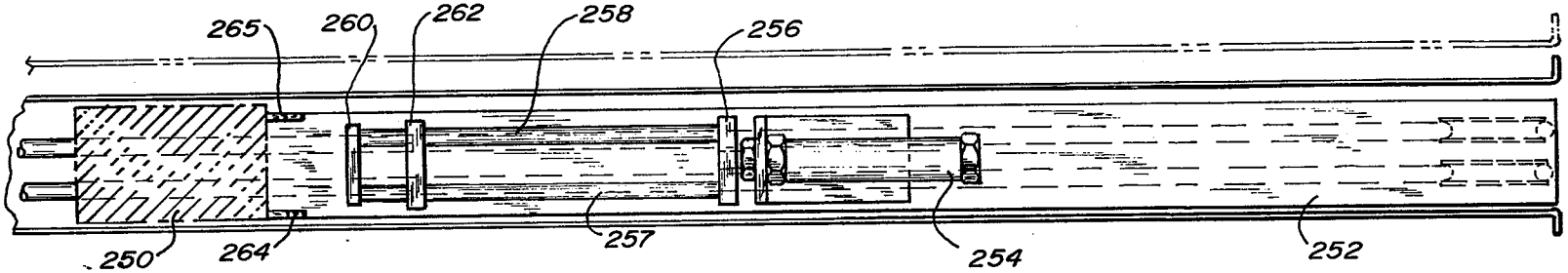
FIG. 20 represents a plan view, partly diagrammatic, of the sponge accumulating apparatus of FIG. 19.
Figure 19:
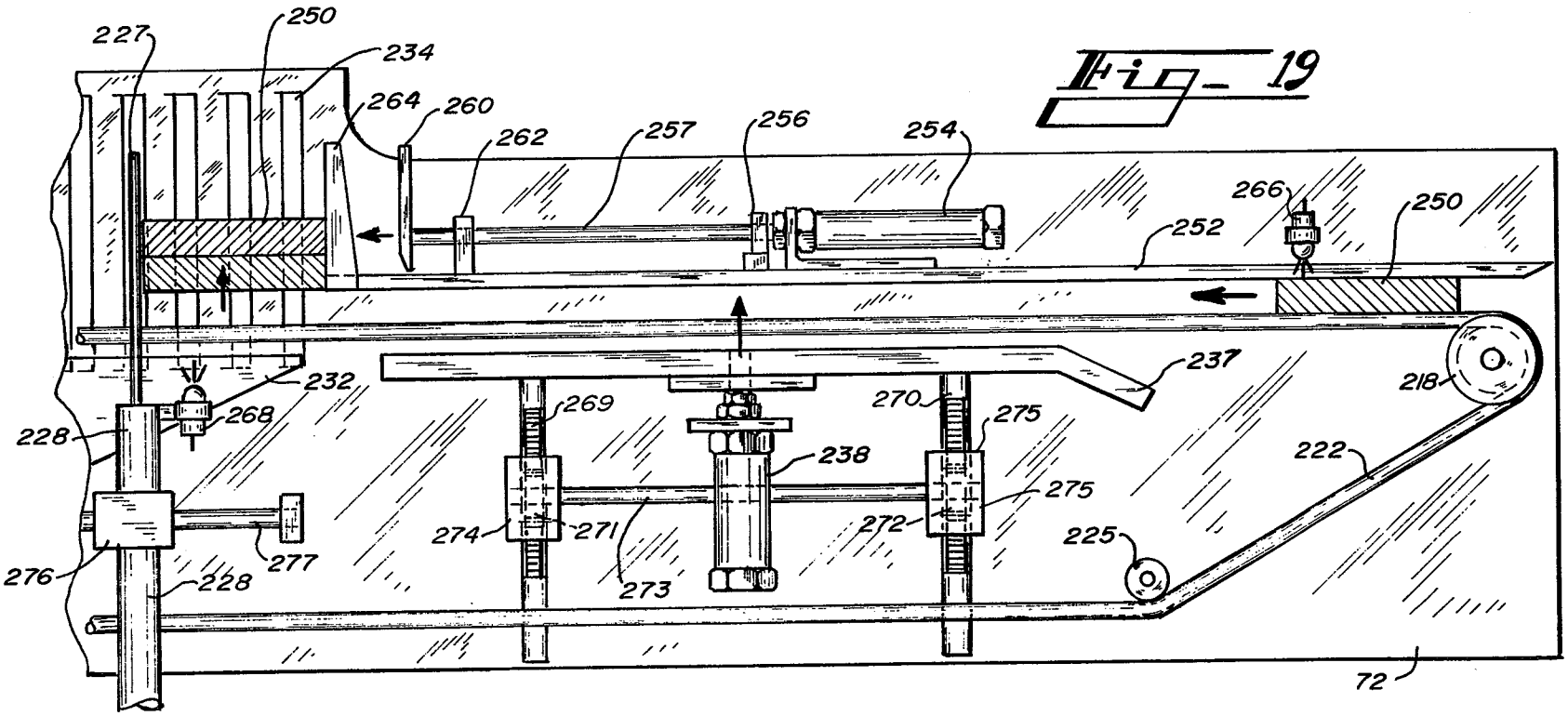
FIG. 19 represents in an enlarged scale and partly diagrammatic a side view of a portion of sponge accumulating apparatus of FIG. 18 and showing in greater detail the upstacking apparatus.

Referring now to FIGS. 19 and 20, an enlarged and more detailed showing of the head end of the conveying section is made. In this showing is a side and plan view portion of this same conveyor. In the enlarged scale only the head end of the conveyor and the up-stacking gripping portion for sponges and the like is shown in FIGS. 19 and 20.

Figure 28:
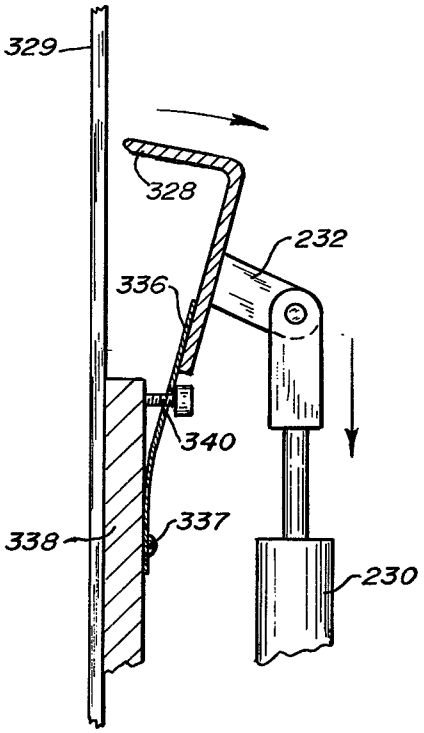
FIG. 28 represents a fragmentary view in an enlarged scale of the up-stacker mechanism and the finger actuating apparatus.
Figure 27:
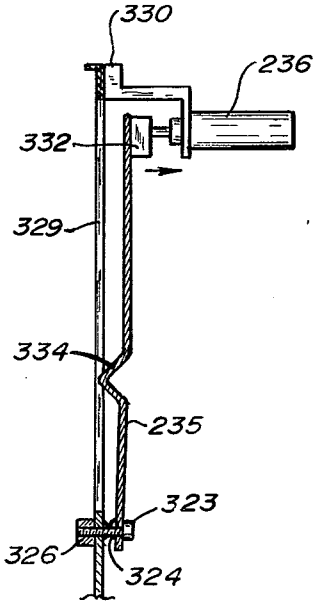
FIG. 27 represents a fragmentary view of the apparatus of FIG. 26 with the cylinder actuated to move the gripping fingers and release the sponge grouping.
Figure 26:
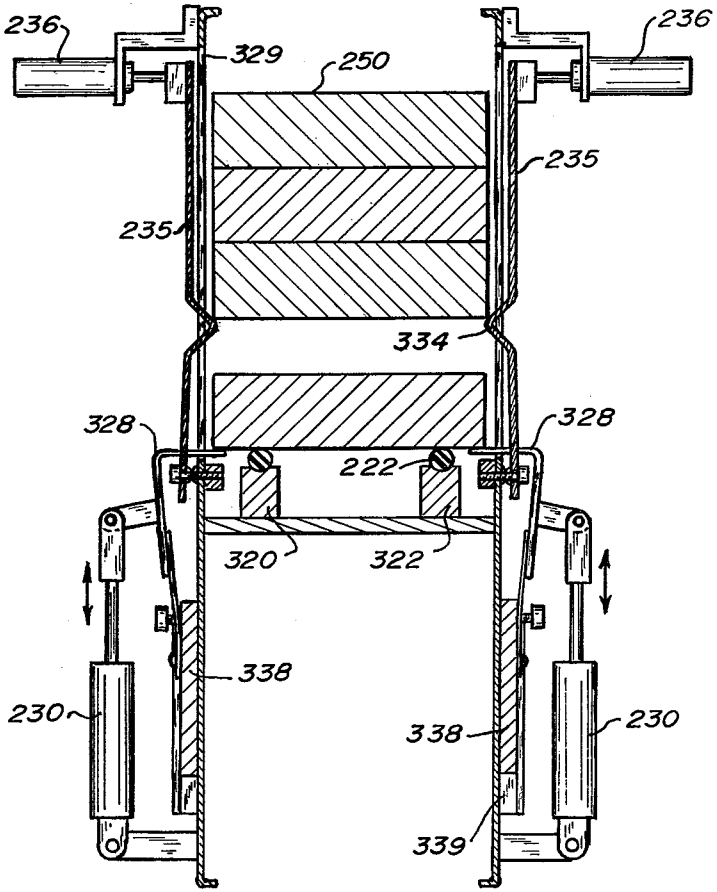

As reduced to practice, the two round belts 222 are each one-half inch in diameter and are moved forwardly around pulleys 218 and 225 which are carried by side frame members 72. As depicted, the lower clamp bar 237 is adapted to move into a gripping condition of an incoming spronge 250 as and when the grouping of sponges has reached the up-stacking section. These sponges are brought in the way of the clamps to be more fully discussed in conjunction with FIGS. 26, 27 and 28. The upstacking clamp 237 pushes an incoming sponge 250 against the upper facing support bar 252 which also carries cylinder 254. Cylinder 254, when actuated, moves header 256 which is attached to rods 257 and 258 and on these rod ends to pusher member 260. The rods 257 and 258 are slidably carried in support 262. The forward pusher member 260 is slidable between end stops 264 and 265 which support and align the ends of the up-stacked sponges 250 as they are moved into a grouped and retained condition. The gripping of the up-stacked sponges and the actuation of the gripping mechanism for the up-stacking of the sponges is shown in FIGS. 26, 27 and 28 and the accumulating and transfer of sponges is shown in FIGS. 21 and 22.

Sensing means is provided on the conveyor shown in FIG. 19. A photosensor 266 is carried at the head or inlet end of this conveyor and a light beam directed between belts 222 is interrupted by the passage of a sponge 250 on the belts. A like photosensor 268 is carried at the accumulating station and the stacking of sponges in the up-stacker interrupts a beam of light "read" by this photosensor. The lower clamp bar 237 is maintained at its desired parallel condition by rack members 269 and 270 which engage pinions 271 and 272 mounted on and secured to turn with shaft 273. Shaft 273 is journaled in suitable bearings in support members 274 and 275 carried by side plate 72. Stop finger 227 as carried by and moved by cylinder 228 is adjustably positioned to accommodate the length of the sponges to be packaged. A clamp 276 tightened by a knob screw 277 holds cylinder 228 at the adjusted position as determined by the operator or supervisor of the equipment. Stop finger 227 is fully extended or retracted by air supplied to cylinder 228.

Figure 21:
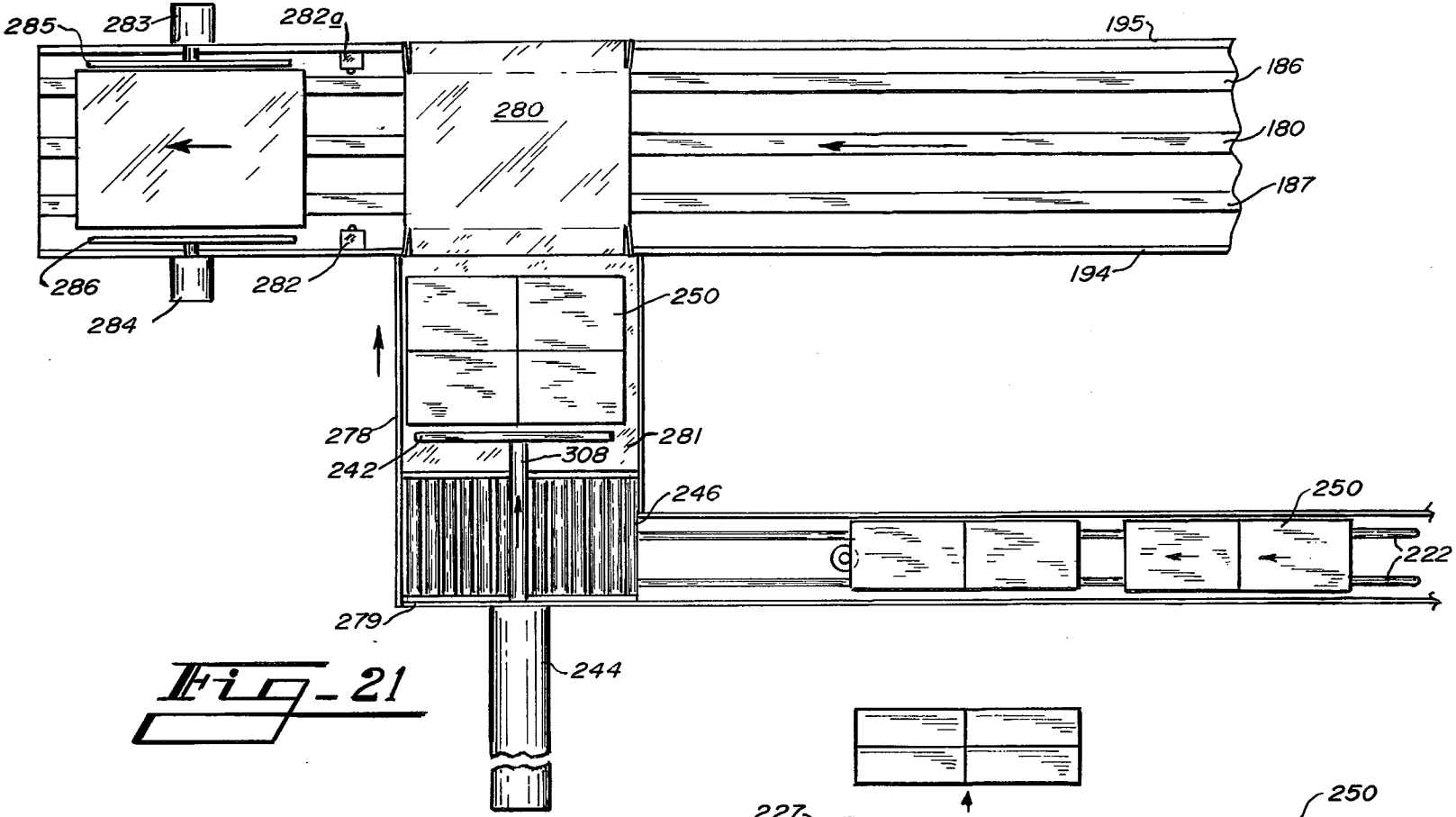
FIG. 21 represents a plan view, partly diagrammatic and schematic of the accumulating, stacking, transferring and closing of the carton in the adjustable case packer apparatus.
Figure 22:
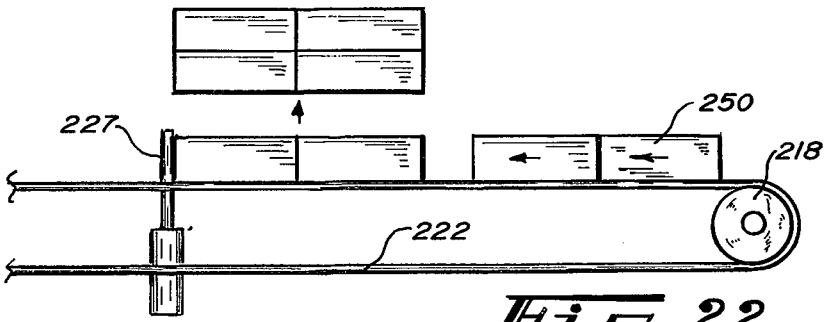
FIG. 22 represents a fragmentary side view, partly diagrammatic, and showing the stacking and accumulating sequence for stackable articles such as sponges, as seen in FIGS. 20 and 21.

ACCUMULATING AND INSERTING APPARATUS AS SEEN IN FIGS. 21 and 22

Referring now to the drawings and FIGS. 21 and 22, there is diagrammatically shown the adjustable conveyor section in association with the adjustable frame section. As shown, center member 180 is positioned intermediate adjustable members 186 and 187 and the side frames 194 and 195 are adjusted to accommodate the laid open size of the infeeding carton. As depicted, sponges 250 are arranged in a layer of four and by three layers high. This group of one dozen is then inserted into an erected carton. Sponges 250 are transported leftwardly, as shown in FIGS. 21 and 22, on conveyor belts 222. As and when the sponges reach the up-stacking section, to be more fully described with relation to FIGS. 26, 27 and 28, they are accumulated. As seen in FIG. 19, clamp 327 inhibits the flow of sponges 250 until an accumulation causes a signal to be actuated from photosensor 266. With this signal the clamp releases the sponges for forward travel on the belts 222. Photosensor 268 reads the presence of this lead sponge and causes clamp 237 is grasp the sponges thereabove. The distance from photosensor 268 to stop finger 227 establishes the distance from the up-stacking group and the clamped sponges as seen in the diagrammatic view of FIG. 22. Four sponges are held until two more sponges on the belts 222 are accumulated and are stopped by stop pin 227. The four above sponges are now released to drop onto these two lower sponges. Stop pin 227 is then lowered and at the speed of the belts 22 the pusher 260 moves the above sponges so as carried by the belts the grouping of six sponges are moved onto rollers 246 and in way of the pusher section 242 and to wall 278. Pusher 242, as moved by cylinder 244, first moves a grouping of six sponges to a position adjacent the open end of an erected carton 280. The group of six sponges is left on slide sheet 281 while cylinder 244 returns the pusher next to outer wall or cover 279. This allows six more sponges to be accumulated during this transfer time interval. As depicted, when the second grouping of six sponges has been brought in way of pusher 242, this pusher is advanced and this dozen sponges is moved into an erected carton 280 which is carried on the erecting section of the apparatus. The filled carton is advanced leftwardly whereby the flaps of the erected carton 280 are brought in way of glue nozzles 282 and **282*a*. The flaps are then turned into a closed position by means of a conventional apparatus and then by means of cylinders 283 and 284, and associated pressure pads 285 and 286 the flaps of the carton are pressed into a sealed engagement. These flaps are held closed by the pressure pads until a next erected carton has been filled and advanced. The pressure pads 285 and 286** are moved to an outward release condition and the packaged carton is then discharged leftwardly from the apparatus to other conventional and comprehensive apparatus.

PUSHER APPARATUS AS SEEN IN FIGS. 23, 24 AND 25

Figure 23:
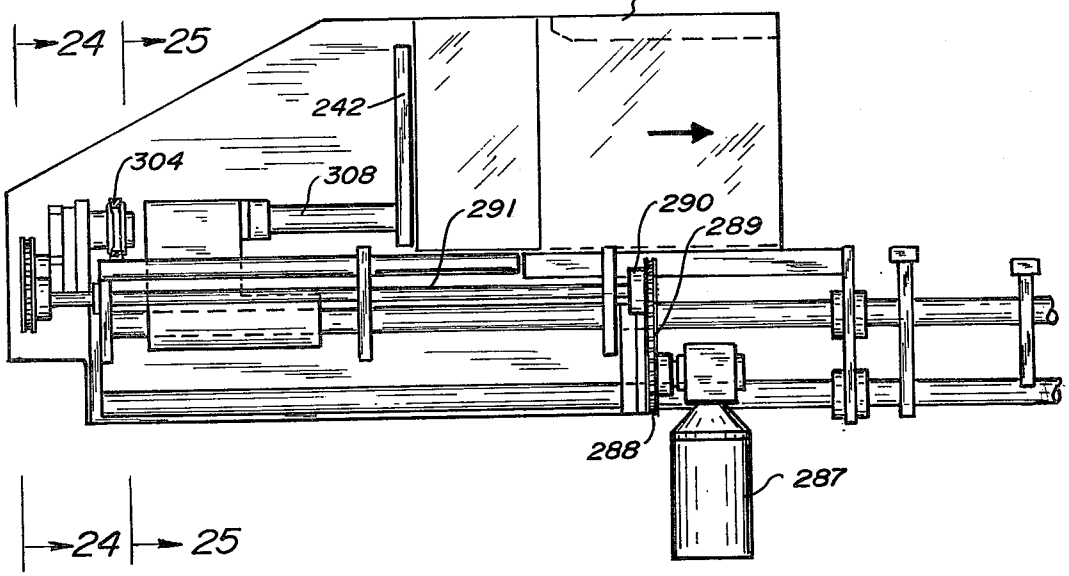
FIG. 23 represents a transverse view, partly diagrammatic of the transfer mechanism for moving the accumulated, packed sponges into an open carton.
Figure 24:
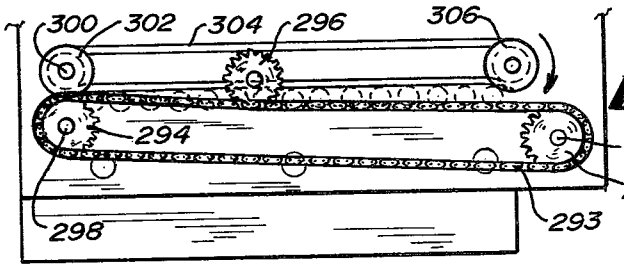
FIG. 24 represents a partly fragmentary end view taken on the line 24—24 of FIG. 23 and looking in the direction of the arrows.
Figure 25:
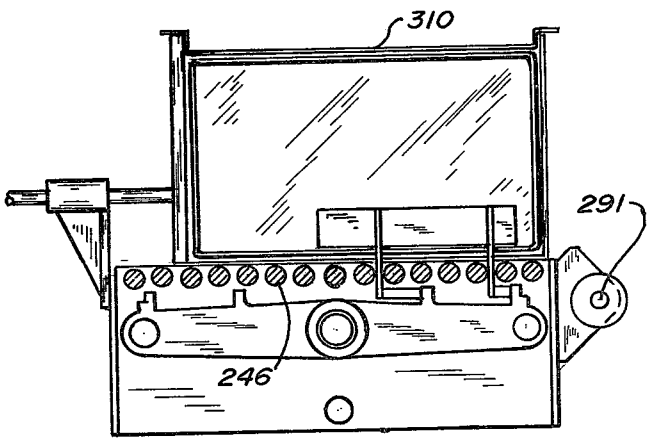
FIG. 25 represents a partly fragmentary and diagrammatic, sectional view taken on the line 25—25 of FIG. 23 and looking in the direction of the arrows.

In FIGS. 23, 24 and 25, there is depicted apparatus which is utilized to accommodate and to be adjusted for packaging of the various sponges. As depicted, a gear motor 287 drives the sprocket 288 and chain 289 which in turn drives sprocket 290 on the right end of drive shaft 291. Shaft 291 moves the belts on the incoming conveyor and also turns a sprocket 292 which carries a roller chain 293. This in turn drives a sprocket 294. The chain 293 is maintained at a desired tension by means of an adjusted idler sprocket 296. The sprocket 294 rotates shaft 298 and a spur gear carried thereon and meshed with a spur gear on shaft 300. As these gears turn they rotate sheave 302 which advances a belt 304 which is carried at its other end by a sheave 306. This movement of belt 309 rotates the several rollers 246 in the direction, as indicated by the arrows in FIG. 24. Pusher rod 308 carries pusher 242 to advance the several sponges 250 in the manner above-described. A guide chute 310 insures that the group of sponges enter the erected carton 280 in the desired and proper attitude.

UP-STACKER APPARATUS OF FIGS. 26–28

Referring next to the FIGS. 26, 27 and 28, there is shown apparatus which is used for the up-stacking of sponges. As seen in FIG. 26, sponges 250 are transported on belts 222. To maintain a precise positioning and carrying of these belts slides 320 and 322 may be used. On each side of these belts and providing guideways for the sponge packages are louvered side fingers 235 in which are formed louvered slots 234. Louvered slots are provided so that leading edges of incoming sponge packages are not engaged by the edges of slots 234.

Bolts, beveled washers and nuts 323, 324 and 326, as seen in FIG. 27, pivotally retain the fingers or plates 235 at their lower ends to side plate 329. This plate carries bracket 330 which carries cylinder 236 which is attached to header 332. At this header 332 is moved the several fingers 235 are moved therewith. Each finger 235 has an inwardly directed V-shaped portion 334 which in its inner condition engages and supports the up-stacked sponges 250. To move the sponges above the V-shaped retaining portion 334 there are provided lifting fingers 328 which may be an extruded angle or bent from sheet metal. On their lower leg portions these fingers are carried by springlike members 336 which at their lower ends are secured by rivets 337 to slide members 338. Slide members 338 are retained laterally by guides 339 (FIG. 26). An adjustable stop 340 carried by block 338 limits the outward swing of the pusher fingers 328. Cylinder 230 moves the bracket 232 in and out and up and down with slide member 338. In a mirror arrangement a like lifting finger and sponge securing finger assembly is provided.

USE AND OPERATION

During the infeed of the sponges 250 on the belts 222, the fingers 328 are positioned so that the tops of these fingers are slightly below the top of the belts and in an out condition as in FIG. 28. As and when a sponge 250 (FIG. 19) has arrived at the stop pin 227, the photosensor 268 initiates a signal which causes the cylinder 230 to move upwardly causing fingers 328 to move to the condition of FIG. 26. Further upward movement of the cylinders 230 cause these fingers to engage the underside of a sponge 250, and lift the sponge or sponges 250 above the V-shaped engaging portions 334. These finger portions 235 carry the sponges while the fingers are moved downwardly.

As the downward motion of cylinder 230 is made, fingers 328 are outward, as seen in FIGS. 28. Spring 336 allows fingers 328 to swing outwardly until stop 340 halts the outer swing. With a halt to the outer movement of the spring 336, slide bracket 338 moves down to the lower position. When cylinder 230 is moved upwardly it moves the fingers 334 inwardly. An accumulation of products 250 above the engaging portions 334 continues until a desired number minus one has been stacked. Pneumatic counting means, not shown, is employed and when the desired number of products retained above fingers 334 has been accumulated, cylinders 236 pull the clamp members 235 outwardly, as seen in FIG. 27, to release the sponges which then drop onto that lower layer of sponges as carried by the belts 222. With the assistance of cylinder 254, the pusher 260 moves the dropped sponges above the belt supported sponges, as in FIGS. 19 and 20 above-described, to the same speed as the sponges carried by the belt so that as a group the sponges are brought to and in way of pusher 242. The cylinder 244 is then actuated to move the stack to an intermediate position or, if a full quantity is accumulated, into the erected carton 280.

As an alternate embodiment, plate members 328, instead of slots for fingers 235, may be formed with a window in which all of the fingers may be positioned. The cylinders 236 still move header 332 and the pivotally supported fingers 235. The sponges 250 as they are moved upwardly by pushing fingers 328 are retained by V-shaped portions 334 in the clamp members 235 which extend inwardly of this window as formed in side 328.

BLOCK DIAGRAM OF FIG. 29

Figure 29:
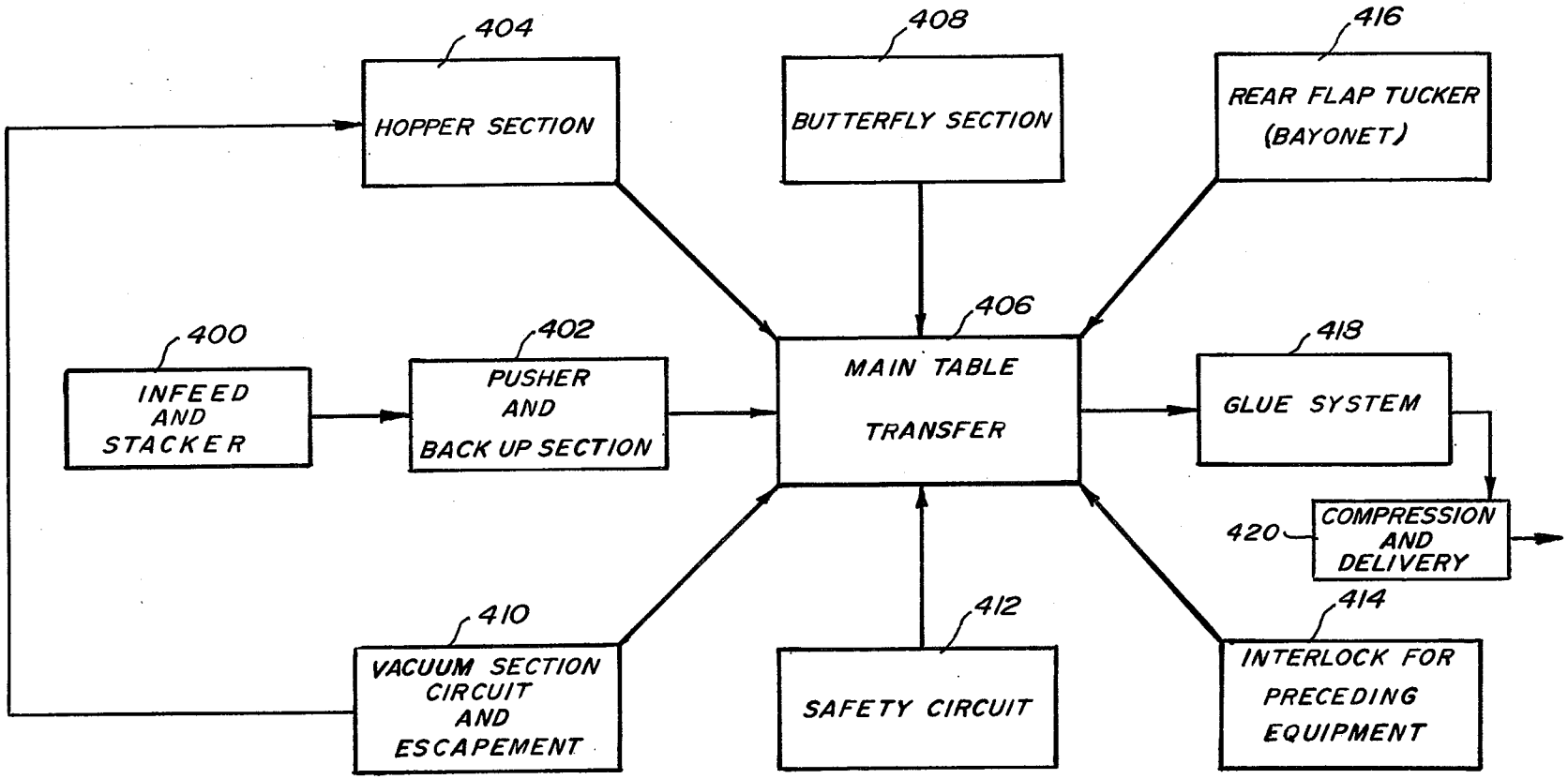
FIG. 29 represents a flow diagram and showing a relationship of the several actions that occur in the case packing operation of the depicted apparatus.

Referring finally to the block diagram as seen in FIG. 29, it is to be noted that an infeed stacker section, as described with FIG. 18, is designated as 400. From this section sponges and like product components move to a pusher and back-up section 402, particularly seen in FIGS. 21 and 23. From there the product is pushed into an erected carton which is moved from a hopper section 404 with and in conjunction with the main table transfer 406. This main table transfer is movable by means of a pneumatic cylinder as shown in the reference patents and application. In combination with this table there is shown an erection system, as seen in FIG. 7. This method assures that the carton is erected to a determined extent. The flaps of the carton are opened prior to product insertion by butterflies, not shown. This action is identified as 408 (the butterfly section). With the movement of the main table transfer, a vacuum section circuit and escapement means, identified as 410 and particularly shown in FIGS. 4 and 7 and the reference patents, insures that the suction cups grasp the lowermost carton and move this carton into a position on the main table transfer as seen in FIG. 21.

A safety circuit 412 is provided so that from many places at and around the apparatus an operator can trip a switch and shut down the entire apparatus.

Also provided in an interlock 414 for proceeding equipment so that if there is a shutdown of incoming supplies the case packer does not continue to operate. This interlock functions with a shutdown of the case packer apparatus. After the main table transfer has been actuated with a loading of the containers or sponges inserted into the erected carton, the carton is advanced forwardly with the rear flap tucker which is represented by a box indicated as 416 and is actuated in response to the movement of the main table transfer. After the carton has been loaded while moving forward, a glue system indicated as 418 places a quantity of hot melt glue upon the vertical flaps of the carton and after pressing (420) as seen in FIG. 21, the packed and now sealed carton is delivered at the next cycle from the apparatus for distribution in the conventional manner.

The above apparatus also provides a method for receiving, transporting, withdrawing and erecting folded cartons for use in and with adjustable case packing apparatus, said method including the steps of providing a frame including side guides adjustably movable to guide a selected size of carton, said frame providing a support surface for receiving and maintaining folded cartons in a substantially side-by-side condition; advancing the folded cartons along said frame and within said guides to an adjustably sized delivery chute wherein the folded cartons are supported in a stacked and sloped condition such as thirty degrees to a horizontal; positioning a carton escapement apparatus in association with the delivery chute with the escapement apparatus having a carton stop reciprocably actuated by a single means whereat in one limit of movement this stop supports an outer edge of the lowermost carton in the sloped stack of folded cartons and when this carton stop is moved to and near its other limit of movement the engaged edge of the lowermost carton is released for removing from the stack; adjusting the width and length of the chute and carton stops to accommodate a size within a selected range of sizes of cartons, the carton escapement positioned to receive and retain and then release the outer edge of the lowermost carton; engaging the lowermost carton by a plurality of cups and vacuum applied thereby and to move this carton to an erected condition; providing an infeed accumulating conveyor to receive the products in a determined grouping; actuating an adjustably controlled pusher for moving the grouping of products from a position adjacent the opened carton to and into the open carton, the stroke so adjusted that the grouping is moved into the erected carton sufficiently for opposite end flaps of the carton to be closed; adjustably moving a means for engaging the leading lower edge of the erected carton and by retaining this carton as it is advanced forwardly whereat the engaging means is moved from an engaging position allowing the filled carton to be further advanced, and gluing, closing and delivering the filled carton from the apparatus.

Terms such as "left", "right", "up", "down", "bottom", "top", "front", "back", "in", "out" and the like are applicable to the embodiments shown and described in conjunction with the drawings. These terms are merely for the purpose of description and do not necessarily apply to the position in which the case packer with size adjustment may be constructed or used.

While particular embodiments of this adjustable case packer for both containers and products have been shown and described it is to be understood the invention is not limited thereto since modifications may be made within the scope of the accompanying claims and protection is sought to the broadest extent the prior art allows.

I claim:

1. Apparatus for receiving, transporting, withdrawing and erecting folded cartons for use in and with adjustable case packing apparatus, said adjustable apparatus including: (a) a frame including side guides adjustably movable to guide a selected size, said frame providing a support surface for receiving and maintaining folded cartons in a substantially side-by-side condition; (b) means for advancing the folded cartons along said frame and within said guides to an adjustably sized delivery chute wherein the folded cartons are supported in a stacked and sloped condition such as thirty degrees to a horizontal; (c) a carton escapement apparatus in association with the delivery chute and having a carton stop actuated by a single means whereat in one limit of movement this stop supports an outer edge of the lowermost carton in the sloped stack of folded cartons and when this carton stop is moved to and near its other limit of movement the engaged edge of the lowermost carton is released for removing from the stack; (d) means for adjusting the width and length of the chute and carton stops to accommodate a selected range of sizes of cartons, the carton escapement positioned to receive and retain and then release the outer edge of the lowermost carton; (e) means for engaging the lowermost carton by a plurality of cups and vacuum applied thereby and to move this carton by these cups and associated apparatus to an erected condition; (f) at least one infeed accumulating conveyor adapted to receive the products to be packaged in a random order and to arrange these products in a determined grouping; (g) an automatically adjustably controlled pusher for moving the grouping of products from a position adjacent the opened carton to and into the opened carton, the stroke so adjusted that the grouping is moved into the erected carton sufficiently for opposite end flaps of the carton to be closed; (h) adjustable means for engaging the leading lower edge of the erected carton and retaining this carton as it is advanced forwardly whereat the engaging means is moved from an engaging position allowing the filled carton to be further advanced, and (i) means for gluing, closing and delivery of the filled carton from the apparatus.

2. Case packing apparatus as in claim 1 in which the carton delivery chute includes a rear stop with an automatic adjustment positioned to provide a support surface normal to the general plane of the folded cartons and movable at substantially right angles to this support surface to lengthen and shorten this surface to accommodate the height extent of the carton.

3. Case packing apparatus as in claim 2 in which the rear stop includes a carton support member which is movable in a plane parallel to the floor, a lower stop member and a support shelf carried thereby, this lower stop movable in a plane parallel to the carton and an intermediate member slidably carried at one end by the lower stop and at its other end the intermediate member is slidably carried by the movable carton support member.

4. Case packing apparatus as in claim 3 in which the delivery chute includes a pneumatically actuated carton stop carried by a rack and pinion assembly and manipulating means to center and clamp the carton stop in the desired position.

5. Case packing apparatus as in claim 2 in which the delivery chute includes a support block on each side of the chute and pivotally carried by each block is an arm which is spring urged upwardly toward the stack of cartons, each arm having a finger pin extending inwardly and parallel to the bottom surface of the folded cartons in the delivery chute, each of said finger pins disposed to enter and pass through a lower separation slot provided by the end flaps in that carton as it is being withdrawn from the chute and during continued withdrawal this pin engages the upper carton and its end flap to assist in carton erecting during this withdrawal.

6. Case packing apparatus as in claim 5 in which the spring urging the arm upwardly is a tension spring having one end secured to the support block and the other end secured to the pivoted arm and there is provided means to limit the upper movement of the arm around the pivot as carried by the support block.

7. Case packing apparatus as in claim 6 in which the finger pin is carried by and as a part of a pneumatic cylinder and movement of this pin in and out is in response to a signal, this pin adjusted in length so as to enter and pass through the separation slot in the lower extent of the carton and then to engage the upper extent of the carton to assist in opening the carton.

8. Case packing apparatus as in claim 7 in which the finger pin after it passes through the lower separation slot engages the upper panel and engages this upper panel until erection is sufficiently advanced to permit withdrawal of the pin at least to the extent the carton is movable to an erected condition.

9. Case packing apparatus as in claim 1 in which the means for engaging the lowermost carton and moving this carton to an erected condition includes a plurality of vacuum cups each carried on a tubular arm connected to a source of vacuum, the arms moved by a pneumatic cylinder and a connected link attached at one end to a reciprocable platform moved by said pneumatic cylinder and at its other end to an arm which is rotatably moved to carry the vacuum cups to the carton in the delivery chute and the vacuum grasped carton to an erected condition in which the leading lower edge is engaged by adjustable means.

10. Case packing apparatus as in claim 9 in which the adjustable means for engaging the leading lower edge includes at least one pivoted stop finger and a pneumatic actuator which moves this pivoted finger into engaging positon as the carton is erected and transported from its loading condition and after transporting, the stop finger is turned by the pneumatic actuator to a non-engaging condition as and while it is moved to a position to retain the next to be erected carton.

11. Case packing apparatus as in claim 10 in which the tubular arms are carried by a header member which is pivotally swung in a fixed path around a fixed axis and for less than one hundred and eighty degrees the to and fro movement of the header is in a timed relationship as established by a timed circuit.

12. Case packing apparatus as in claim 1 in which the adjustably sized delivery chute for retaining the folded cartons further includes upper and lower rack members carried with and by the sides of the chute and on the head end of the chute are carried upper stops on block members, each block of which carries a pair of spur gears in mesh with each other and with one gear also in mesh with one rack and the other gear also in mesh with the other rack, these spur gears carried on shafts at least one of which extends to and into the other block on the other side when a pair of like pinions are in driving mesh with each other and with the rack members carried on the far side of the chute.

13. Case packing apparatus as in claim 12 in which there are two shafts that extend between the upper block members and on these shafts are rack means for self-centering a midblock as the sides of the chute are moved and on which is carried the carton stop apparatus.

14. Case packing apparatus as in claim 13 in which there is provided clamp means for securing the midblock in self-centered position after the sides of the chute are moved to the desired spacing.

15. Case packing apparatus as in claim 1 in which adjustment of the sideguides of the frame includes a center member in which are rotatably carried a plurality of threaded shafts, each shaft having right- and left-hand threads; at least two intermediate plate-like members at similar distances from the center member, each intermediate member carrying at least two nuts adjustably mounted in each plate and threaded to conform to the thread of the screw on which they are mounted, the nuts after positioning being secured in a fixed condition in the intermediate plate; a roller chain sprocket carried on each shaft, the sprockets connected by a roller chain and turning means on one of the shafts so that as one shaft is turned the roller chain connected shaft turns a like amount to move the threaded shaft in the nut to cause like movement of the intermediate plates toward and away from the center plate.

16. Case packing apparatus as in claim 15 in which the outer members are also adjustably movable toward and away from the center member, the center member also rotatably carrying a plurality of threaded shafts associated with the outer members, these shafts also having right- and left-hand threads; at least two nuts adjustably mounted in each plate and threaded to conform to the thread of the screw on which they are mounted, the nuts after positioning being secured in a fixed condition in the outer plate; a roller chain sprocket carried on each shaft, the sprockets connected by a roller chain and turning means on one of the shafts so that as one shaft is turned the roller chain connected shaft turns a like amount to move the threaded shaft in the nut to cause the movement of the outer plates toward and away from the center plate.

17. Case packing apparatus as in claim 1 in which the adjustably sized delivery chute for retaining the folded cartons further includes a lower rack member carried with and by the sides of the chute and on the head end of the chute are carried upper stops on block members, each block of which carries a spur gear in mesh with the lower rack, these spur gears carried on a shaft which extends to and into the other block on the other side with a like pinion in driving mesh with the other lower rack member carried on the far side of the chute.

18. Case packing apparatus as in claim 1 in which a multiplicity of small, like-sized containers such as quarts, pints and the like are fed randomly on and along an infeed conveyor whereon they are accumulated and aligned in determined rows by guides and with an accumulation of a selected number and a determined pattern a signal is generated whereby a pusher contoured to nest the outermost engaged containers engages and pushes this grouping into the erected carton.

19. Case packing apparatus as in claim 1 in which a multiplicity of like-sized products such as sponges are fed in aligned array and in a random spacing on and along an infeed conveyor which includes a stop finger which is carried by a reciprocating means so as to move into and from in way of the inflow of products along said conveyor and at a single height; detecting means at said stop finger position to determine a selected grouping of products; an up-stacking means in association with said detecting means, this up-stacking moving the selected grouping of products into a holding array above the infeed conveyor until a selected number has been accumulated after which the stop finger is moved from in way of the accumulation which is then moved in way of the pusher for transfer to and into the erected carton.

20. Case packing apparatus as in claim 19 in which the infeeding conveyor includes a pair of round belts carried so as to provide like spaced apart support extents and at a determined distance and before the up-stacking apparatus there is provided above the carrying surface of these belts an upper clamp bar of selected length and between and below these belts is a lower clamp member of a like length which is movable upwardly between the belts to grip those products being carried forwardly on said belts between the upper and lower clamp members and halt forward progress of said products as an up-stacking of a grouping of products is being made.

21. Case packing apparatus as in claim 20 in which the lower clamp member is moved up and down by a pneumatic cylinder and alignment of the lower clamp member is by a plurality of rack members carried by the lower clamp member, and pinions in operative engagement with these racks, the pinions carried by and fixed to a common shaft which is journaled in blocks carried by the side frame, the actuation of the clamp member and upstacking apparatus being in response to a counting signal actuated by photosensors in way of the path of the products.

22. Case packing apparatus as in claim 21 in which there is provided means for releasing the up-stacked products so as to drop into a grouping of products as accumulated on the conveyor belts at the stop finger, and when and as the stop finger is moved from in way of the packaged products the grouping is moved onto powered rollers where the grouping is brought in way of a pusher member which is then actuated to move the grouping at least part way toward the erected carton.

23. Case packing apparatus in claim 22 in which the powered rollers on which the product is advanced in way of the pusher is powered by a belt driven by the means propelling the infeed conveyor so that shutting down of the incoming conveyor also results in a like shutting down of the roller movement.

24. Case packing apparatus as in claim 21 in which the upstacking apparatus includes side plates along each side of the infeed conveyor carrying the product with an access opening formed in each side plate arranged to provide a plurality of louvered slots in finger members in said opening, these finger members movable to and from a product retaining position by a pneumatic means carried by the side plate; a V-shaped inwardly extending product engaging means formed in each finger member, this V-portion shaped portion adapted to engage and retain the lower edge/portion of a product when moved thereabove and lift finger means movable in the slots of the finger members and for lifting the product above the V-shaped product engaging means.

25. Case packing apparatus as in claim 24 in which the means for lifting the product includes a plurality of lift fingers arranged for simultaneous movement and with the fingers arranged at least as pairs on each side of the conveyor, the fingers as the product is moved into the up-stacking apparatus at a given signal engage the underside of the product and lift this product above the V-shaped engaging means, these fingers movable upwardly and downwardly in the slots formed in the clamp member.

26. Case packing apparatus as in claim 25 in which the lift fingers are actuated by a pneumatic cylinder, these fingers including an angle-shaped portion which is attached and carried on its lower end by a leaf spring attached to a slide member, this slide member movable within selected limits; an outer limit means to the movement of the leaf spring and a short link arm attached to each finger and at the outer end of this arm a pivotable attachment to the rod end of this pneumatic cylinder; an upward signal to the cylinder causing the finger, spring slide and arm to move upwardly while in product engaging and supporting position and with a downward signal the pneumatic cylinder draws the rod downwardly, first drawing the arm and attached finger outwardly until the outer limit means of the spring is reached whereupon the fingers are moved from a product supporting condition and then downwardly with the slide to a bottom limit with the left fingers in the out condition until the cylinder is moved to cause product lifting condition.

27. Case packing apparatus as in claim 21 in which the upstacking apparatus includes side plates along each side of the infeed conveyor carrying the product; a plurality of louvered slots formed in each finger, the louvers providing access slots without presenting engaging edges to the advanced product; pivotally mounted fingers spaced to provide slots and movable to and from retaining position by pneumatic means carried on a side plate; a V-shaped inwardly extending product engaging means formed in each finger and adapted to engage the lower edge portion of a product when moved thereabove, and means movable in the slots of the fingers and providing a means for lifting the product above the V-shaped product engaging means.

28. A method for receiving, transporting, withdrawing and erecting folded cartons for use in and with adjustable case packing apparatus, said method including the steps of: (a) providing a frame including side guides adjustably movable to guide a selected size of carton, said frame providing a support surface for receiving and maintaining folded cartons in a substantially side-by-side condition; (b) advancing the folded cartons along said frame and within said guides to an adjustably sized delivery chute wherein the folded cartons are supported in a stacked and sloped condition such as thirty degrees to a horizontal; (c) positioning a carton escapement apparatus in association with the delivery chute with the escapement apparatus having a carton stop actuated by a single means whereat in one limit of movement this stop supports an outer edge of the lowermost carton in the sloped stack of folded cartons and when this carton stop is moved to and near its other limit of movement the engaged edge of the lowermost carton is released for removing from the stack; (d) adjusting the width and length of the chute and carton stops to accommodate a size within a selected range of sizes of cartons, the carton escapement positioned to receive and retain and then release the outer edge of the lowermost carton; (e) engaging the lowermost carton by a plurality of cups and vacuum applied thereby and to move this carton to an erected condition; (f) providing at least one infeed accumulating conveyor to receive the products in a determined grouping; (g) actuating an automatically, adjustably controlled pusher for moving the grouping of products from a position adjacent the opened carton to and into the opened carton, the stroke so adjusted that the grouping is moved into the erected carton sufficiently for opposite end flaps of the carton to be closed; (h) adjustably moving a means for engaging the leading lower edge of the erected carton and for retaining this carton as it is advanced forwardly whereat the engaging means is moved from an engaging position allowing the filled carton to be further advanced, and (i) gluing, closing and delivering the filled carton from the apparatus.

29. A method of case packing as in claim 28 which includes the further step of mounting in the delivery chute a pneumatically actuated carton stop carried by a rack and pinion assembly and establishing manipulating means to center and clamp the carton stop in the desired position.

30. A method of case packing as in claim 28 which includes the further step of forming the delivery chute to include a support block on each side of the chute and pivotally carrying on each block an arm which is spring urged upwardly toward the stack of cartons and providing each arm with a finger pin extending inwardly and parallel to the bottom surface of the folded cartons in the delivery chute, each of said finger pins disposed to enter and pass through a lower separation slot provided by the end flaps in that carton as it is being withdrawn from the chute and during continued withdrawal this pin engages the upper carton and its end flap to assist in carton erecting during this withdrawal.

31. A method of case packing as in claim 30 which further includes the steps of carrying the finger pin by and as a part of a pneumatic cylinder and movement of this pin in and out is in response to a signal, this pin adjusted in length so at to enter and pass through the separation slot in the lower extent of the carton and then to engage the upper extent of the carton to assist in opening the carton.

32. A method of case packing as in claim 31 which further includes actuating the finger pin after it passes through the lower separation slot so as to engage this upper panel until erection is sufficiently advanced to permit withdrawal of the pin at least to the extent the carton is movable to an erected condition.

33. A method of case packing as in claim 28 which includes the further steps of feeding a multiplicity of like-sized products such as sponges in aligned array and in a random spacing on and along an infeed conveyor and carrying a stop finger by and with a reciprocating means so as to move into and from in way of the inflow of products along said conveyor and at a single height; detecting at said stop finger position a selected grouping of products; actuating an up-stacking means with a signal from said detecting means, this up-stacking moving the selected grouping of products into a holding array above the infeed conveyor until a selected number has been accumulated after which the stop finger is moved from in way of the accumulation which is then moved in way of a pusher for transferring to and into the erected carton.

34. A method for case packing as in claim 28 which includes the steps of arranging the up-stacking apparatus side plates along each side of the infeed conveyor carrying the product and forming an access opening in each side plate; pivotally mounting side finger members to provide a plurality of louvered slots in each assembly, each finger movable to and from a product retaining position by a pneumatic means carried by the side plate; forming a V-shaped inwardly extending product engaging means in each finger member, this V-shaped portion adapted to engage and retain the lower edge portion of a product when moved thereabove and providing a finger means movable in the slots between the finger members for lifting the product above the V-shaped product engaging means.

35. A method for case packing as in claim 34 which includes the further step of lifting the product by a plurality of lift fingers arranged for simultaneous movement and with the fingers arranged at least as pairs on each side of the conveyor, the fingers as the product is moved into the up-stacking apparatus at a given signal engaging the underside of the product and lifting this product above the V-shaped engaging means, these fingers movable upwardly and downwardly in the slots formed in the clamp member.

36. A method for case packing as in claim 35 which includes the steps of moving the lift fingers by a pneumatic cylinder, these fingers including an angle-shaped portion which is attached and carried on its lower end by a leaf spring attached to a slide member and moving this slide member within selected limits and providing an outer limit to the movement of the leaf spring and attaching a short link arm to each finger at the outer end of this arm to provide a pivotable attachment to the rod end of this pneumatic cylinder; an upward signal to the cylinder causing the finger, spring slide and arm to move upwardly while in product engaging and supporting position and with a downward signal the pneumatic cylinder drawing the rod downwardly, first moving the arm and attached finger outwardly until the outer limit means of the spring is reached whereupon the fingers are moved from a product supporting condition and then downwardly with the slide to a bottom limit.

* * * * *